US008277010B2

(12) United States Patent
Yoshida

(10) Patent No.: US 8,277,010 B2
(45) Date of Patent: Oct. 2, 2012

(54) IMAGE FORMING DEVICE THAT PERFORMS BI-DIRECTIONAL PRINTING WHILE CALIBRATING CONVEYING AMOUNT OF RECORDING MEDIUM

(75) Inventor: Yasunari Yoshida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 459 days.

(21) Appl. No.: 12/613,005

(22) Filed: Nov. 5, 2009

(65) Prior Publication Data

US 2010/0214339 A1 Aug. 26, 2010

(30) Foreign Application Priority Data

Feb. 26, 2009 (JP) ..... 2009-044381

(51) Int. Cl.
*B41J 29/38* (2006.01)

(52) U.S. Cl. ..... 347/14; 347/16; 347/19

(58) Field of Classification Search ..... None
See application file for complete search history.

(56) References Cited

U.S. PATENT DOCUMENTS

| | | | | |
|---|---|---|---|---|
| 6,454,390 | B1 | 9/2002 | Takahashi et al. | |
| 7,021,737 | B2 * | 4/2006 | Yamada | 347/19 |
| 2004/0257394 | A1 | 12/2004 | Hoshiyama et al. | |
| 2005/0046654 | A1 * | 3/2005 | King et al. | 347/16 |
| 2006/0197785 | A1 * | 9/2006 | Uchida | 347/5 |
| 2007/0008354 | A1 * | 1/2007 | Hayashi et al. | 347/9 |
| 2007/0008363 | A1 | 1/2007 | Hamasaki et al. | |
| 2007/0291059 | A1 | 12/2007 | Hayashi et al. | |
| 2008/0049353 | A1 * | 2/2008 | Nakano et al. | 360/69 |

FOREIGN PATENT DOCUMENTS

| | | | |
|---|---|---|---|
| JP | H08-216456 | A | 8/1996 |
| JP | H09-156159 | A | 6/1997 |
| JP | H11-291470 | A | 10/1999 |
| JP | 2004-249713 | A | 9/2004 |
| JP | 2005-125699 | A | 5/2005 |
| JP | 2005-335343 | A | 12/2005 |
| JP | 2006-218774 | A | 8/2006 |
| JP | 2007-038662 | A | 2/2007 |
| JP | 2007-185843 | A | 7/2007 |
| JP | 2008-023982 | A | 2/2008 |
| JP | 2008-119951 | A | 5/2008 |

OTHER PUBLICATIONS

Japan Patent Office, Office Action for Japanese Patent Application No. 2009-044381 (counterpart to above-captioned patent application), mailed Mar. 29, 2011.

* cited by examiner

*Primary Examiner* — Ryan Lepisto
*Assistant Examiner* — Andrew Jordan
(74) *Attorney, Agent, or Firm* — Baker Botts L.L.P.

(57) ABSTRACT

An image forming device performs a bi-directional printing operation and includes a unit that determines a first amount by calibrating a predetermined amount based on a first value relating to a positional offset of a print element, and a unit that determines a second amount by calibrating the predetermined amount based on a second value relating to a positional offset of another print element. A recording medium is conveyed in a conveying direction the first amount after one of forward and reverse prints and the second amount after the other of the forward and reverse prints.

5 Claims, 11 Drawing Sheets

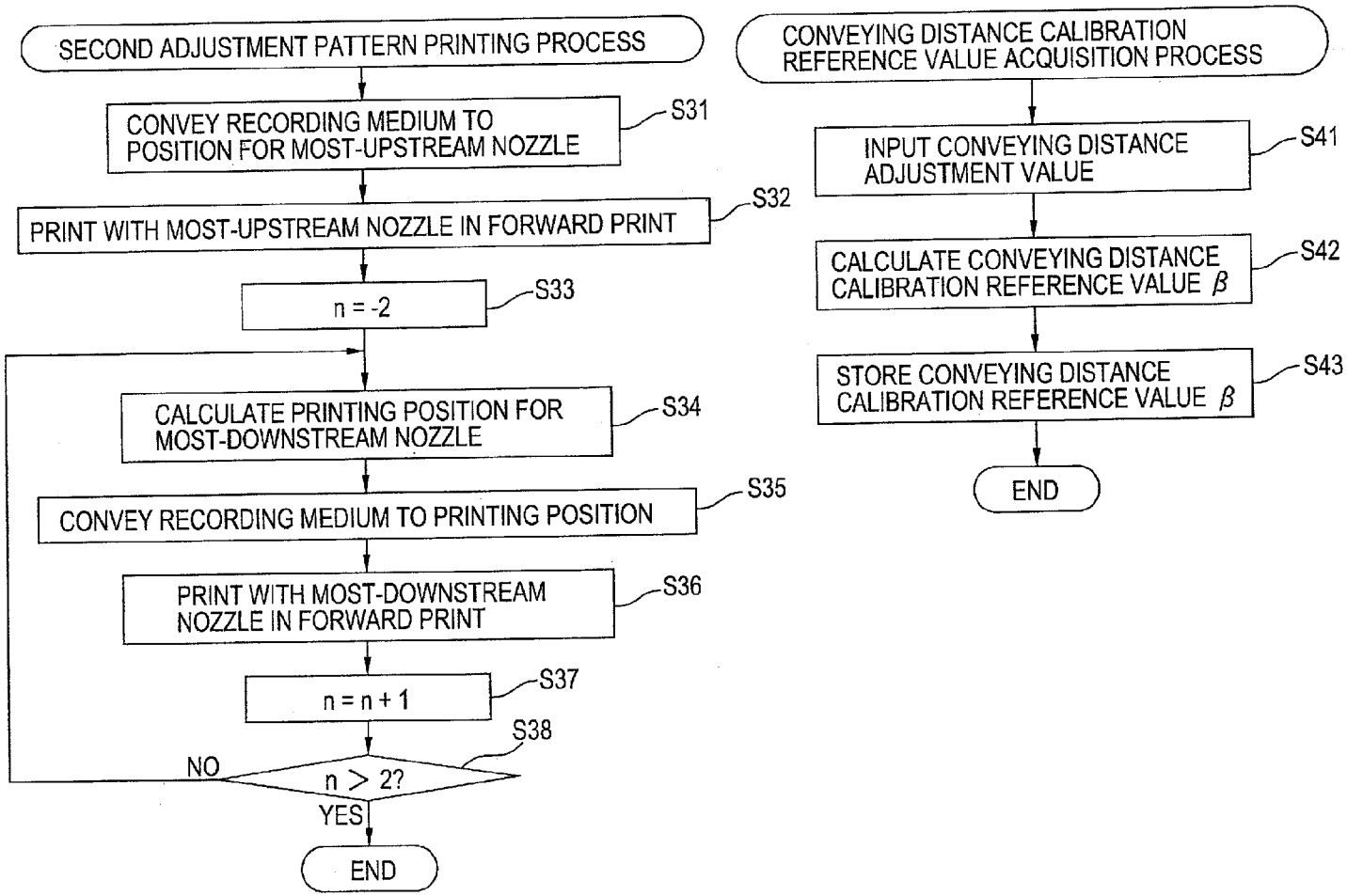
FIG.5(a)
SECOND ADJUSTMENT PATTERN PRINTING PROCESS
S31
CONVEY RECORDING MEDIUM TO POSITION FOR MOST-UPSTREAM NOZZLE
S32
PRINT WITH MOST-UPSTREAM NOZZLE IN FORWARD PRINT
S33
n = -2
S34
CALCULATE PRINTING POSITION FOR MOST-DOWNSTREAM NOZZLE
S35
CONVEY RECORDING MEDIUM TO PRINTING POSITION
S36
PRINT WITH MOST-DOWNSTREAM NOZZLE IN FORWARD PRINT
S37
n = n + 1
S38
n > 2?
YES
NO
END
FIG.5(b)
CONVEYING DISTANCE CALIBRATION REFERENCE VALUE ACQUISITION PROCESS
S41
INPUT CONVEYING DISTANCE ADJUSTMENT VALUE
S42
CALCULATE CONVEYING DISTANCE CALIBRATION REFERENCE VALUE β
S43
STORE CONVEYING DISTANCE CALIBRATION REFERENCE VALUE β
END B
200f
200r
G1 (n=-2)
G2 (n=-2)
G1 (n=0)
G2 (n=+2)
G2 (n=0)
G2 (n=-1)
Pm
P (m+1)
P (m+2)
P (m+3)
X+Af (Af<0)
X+Af (Af=0)
X+Ar (Ar>0)
X+Ar (Ar<0)
X+Ar (Ar=0)
Af<0
Af=0
Ar>0
Ar<0
Ar=0
G1
G2
201
202
203

B
190
191b
191a
L=N×R
R
F

B
γ
L'
190
191b
191a
R
F

B
Pa
190
191b
191a
N×R

B
Pa
190
191b
191a
L'

IMAGE FORMING DEVICE THAT PERFORMS BI-DIRECTIONAL PRINTING WHILE CALIBRATING CONVEYING AMOUNT OF RECORDING MEDIUM

CROSS REFERENCE TO RELATED APPLICATION

This application claims priority from Japanese Patent Application No. 2009-044381 filed Feb. 26, 2009. The entire content of this priority application is incorporated herein by reference.

TECHNICAL FIELD

The present invention relates to an image forming device that performs bi-directional printing.

BACKGROUND

In a bi-directional printing operation, a print head reciprocated in a main scanning direction prints (i.e., ejects ink) while moving in both forward and reverse directions. In the following description, print performed by the print head while moving in the forward direction will be referred to as "forward print", and print performed while moving in the reverse direction will be referred to as "reverse print". In other words, the print head performs the forward print and the reverse print while reciprocatingly moving in the main scanning direction.

In such bi-directional printing operations, printing positions on a recording medium at which ink is ejected in the forward print and the reverse print may be offset from each other with respect to the main scanning direction. For example, when forming a vertical ruled line along a sub-scanning direction, a phenomenon called "ruled line offset" may occur in which the position of the ruled line formed in the forward print is offset in the main scanning direction from the position of the ruled line formed in the reverse print.

A method for aligning the printing positions in this type of situation has been proposed. This method finds a parameter indicating the printing positions in the forward and reverse directions that are most closely aligned and sets a printing start timing for printing in the reverse direction based on the parameter in order to reduce the occurrence of ruled line offset.

At the same time, there is market demand for inexpensive printers. Most manufacturers are able to offer low-cost printers by keeping down the costs of the mechanical structure therein. However, when using an inexpensive mechanical structure in a printer, the print head may tilt with respect to the sub-scanning direction during a bi-directional printing operation at a different angle, depending on whether the print head is being conveyed in the forward direction or the reverse direction, resulting in a decline in image quality.

SUMMARY

In view of the foregoing, it is an object of the present invention to provide an image forming device, a control method, and a control program capable of preventing a decline in image quality caused by tilting with respect to a sub-scanning direction of a print head when the print head is conveyed in each direction during bi-directional printing operations.

In order to attain the above and other objects, the invention provides an image forming device including a print head, a head moving mechanism, a first memory, a second memory, a first amount determining unit, a second amount determining unit, and a conveying mechanism. The print head is formed with a plurality of print elements for forming an image on a recording medium, and the print elements includes a downstream element and an upstream element positioned upstream of the downstream element in a conveying direction. The head moving mechanism is for reciprocatingly moving the print head in a forward direction and a reverse direction opposite from the forward direction. The print head performs a bi-directional printing including a first print for forming a first image while being moved in the forward direction and a second print for forming a second image while being moved in the reverse direction. Both the forward direction and the reverse direction are orthogonal to the conveying direction. The first memory stores a first value relating to an amount of offset in the conveying direction between a first position on the recording medium at which a first test image is formed with the downstream element in the first print when the recording medium is at a first predetermined position and a second position on the recording medium at which a second test image is formed with the downstream element in the second print when the recording medium is at the first predetermined position. The second memory stores a second value relating to an amount of offset in the conveying direction between a third position on the recording medium at which a third test image is formed with the upstream element in the first print when the recording medium is at a second predetermined position and a fourth position on the recording medium at which a fourth test image is formed with the upstream element in the second print when the recording medium is at the second predetermined position. The first amount determining unit determines a first amount by correcting a predetermined amount based on the first value stored in the first memory. The second amount determining unit determines a second amount by correcting the predetermined amount based on the second value stored in the second memory. The conveying mechanism conveys the recording medium toward a downstream side in the conveying direction relative to the print head the first amount after one of the first print and the second print is performed and the second amount after the other of the first print and the second print is performed.

There is also provided a control method for controlling an image forming device including a print head, a head moving mechanism, a first memory, a second memory, a first amount determining unit, a second amount determining unit, and a conveying mechanism. The print head is formed with a plurality of print elements for forming an image on a recording medium, and the print elements includes a downstream element and an upstream element positioned upstream of the downstream element in a conveying direction. The head moving mechanism is for reciprocatingly moving the print head in a forward direction and a reverse direction opposite from the forward direction. The print head performs a bi-directional printing including a first print for forming a first image while being moved in the forward direction and a second print for forming a second image while being moved in the reverse direction, and both the forward direction and the reverse direction are orthogonal to the conveying direction. The first memory stores a first value relating to an amount of offset in the conveying direction between a first position on the recording medium at which a first test image is formed with the downstream element in the first print when the recording medium is at a first predetermined position and a second position on the recording medium at which a second test image is formed with the first element in the second print when the recording medium is at the first predetermined position. The second memory stores a second value relating to an amount of offset in the conveying direction between a third position on the recording medium at which a third test image is formed with the upstream element in the first print when the recording medium is at a second predetermined position and a fourth position on the recording medium at which a fourth test image is formed with the upstream element in the second print when the recording medium is at the second predetermined position. The control method includes determining a first amount by correcting a predetermined amount based on the first value stored in the first memory, determining a second amount by correcting the predetermined amount based on the second value stored in the second memory, conveying the recording medium toward a downstream side in the conveying direction relative to the print head the first amount after one of the first print and the second print is performed, and conveying the recording medium toward the downstream side in the conveying direction relative to the print head the second amount after the other of the first print and the second print is performed.

There is also provided a storage medium storing a set of program instructions executable on a data processing device and usable for controlling an image forming device including a print head, a head moving mechanism, a first memory, a second memory, a first amount determining unit, a second amount determining unit, and a conveying mechanism. The print head is formed with a plurality of print elements for forming an image on a recording medium, and the print elements includes a downstream element and an upstream element positioned upstream of the downstream element in a conveying direction. The head moving mechanism is for reciprocatingly moving the print head in a forward direction and a reverse direction opposite from the forward direction. The print head performs a bi-directional printing including a first print for forming a first image while being moved in the forward direction and a second print for forming a second image while being moved in the reverse direction, and both the forward direction and the reverse direction are orthogonal to the conveying direction. The first memory stores a first value relating to an amount of offset in the conveying direction between a first position on the recording medium at which a first test image is formed with the downstream element in the first print when the recording medium is at a first predetermined position and a second position on the recording medium at which a second test image is formed with the first element in the second print when the recording medium is at the first predetermined position. The second memory stores a second value relating to an amount of offset in the conveying direction between a third position on the recording medium at which a third test image is formed with the upstream element in the first print when the recording medium is at a second predetermined position and a fourth position on the recording medium at which a fourth test image is formed with the upstream element in the second print when the recording medium is at the second predetermined position. Instructions includes determining a first amount by correcting a predetermined amount based on the first value stored in the first memory; determining a second amount by correcting the predetermined amount based on the second value stored in the second memory; conveying the recording medium toward a downstream side in the conveying direction relative to the print head the first amount after one of the first print and the second print is performed; and conveying the recording medium toward the downstream side in the conveying direction relative to the print head the second amount after the other of the first print and the second print is performed.

BRIEF DESCRIPTION OF THE DRAWINGS

The particular features and advantages of the invention as well as other objects will become apparent from the following description taken in connection with the accompanying drawings, in which:

FIG. 2(*b*) is a side view of the convey unit;

FIG. 3(*b*) is a flowchart representing a positional offset calibration value acquisition process according to the embodiment;

FIG. 4(*b*) is a view conceptually illustrating remaining of print results of the first adjustment pattern printing process;

FIG. 5(*a*) is a flowchart representing a second adjustment pattern printing process according to the embodiment;

FIG. 5(*b*) is a flowchart representing a conveying distance calibration reference value acquisition process according to the embodiment;

FIG. 9(*b*) is a view conceptually illustrating printing regions covered by a forward print and a reverse print by an ink head of a different example;

FIG. 9(*c*) is a view conceptually illustrating printing regions covered by a forward print and a reverse print by an ink head of a still different example;

FIG. 9(*d*) is a view conceptually illustrating printing regions covered by a forward print and a reverse print by an ink head of a further different example;

FIG. 9(*e*) is a view conceptually illustrating printing results obtained with the ink head of FIG. 9(*a*);

FIG. 9(*f*) is a view conceptually illustrating printing results obtained with the ink head of FIG. 9(*b*);

FIG. 9(*g*) is a view conceptually illustrating printing results obtained with the ink head of FIG. 9(*c*);

FIG. 9(*h*) is a view conceptually illustrating printing results obtained with the ink head of FIG. 9(*d*);

FIG. 10(*b*) is an explanatory plan view of the ink head tilted in a main scanning direction with respect to the paper-conveying direction;

FIG. 10(*c*) is an explanatory side view of the ink head not tilted with respect to the paper-conveying direction;

FIG. 10(*d*) is an explanatory side view of the ink head tilted upward with respect to the paper-conveying direction;

FIG. 11(*b*) is a view conceptually illustrating printing results obtained when the ink head is not tilted with respect to the paper-conveying direction in a forward print but is tilted in a reverse print.

DETAILED DESCRIPTION

An image forming device according to an embodiment of the invention will be described while referring to the accompanying drawings. The present embodiment pertains to a printer 1 shown in FIG. 1. The term "below" and the like will be used throughout the description assuming that the printer 1 is disposed in an orientation in which it is intended to be used.

Figure 1:
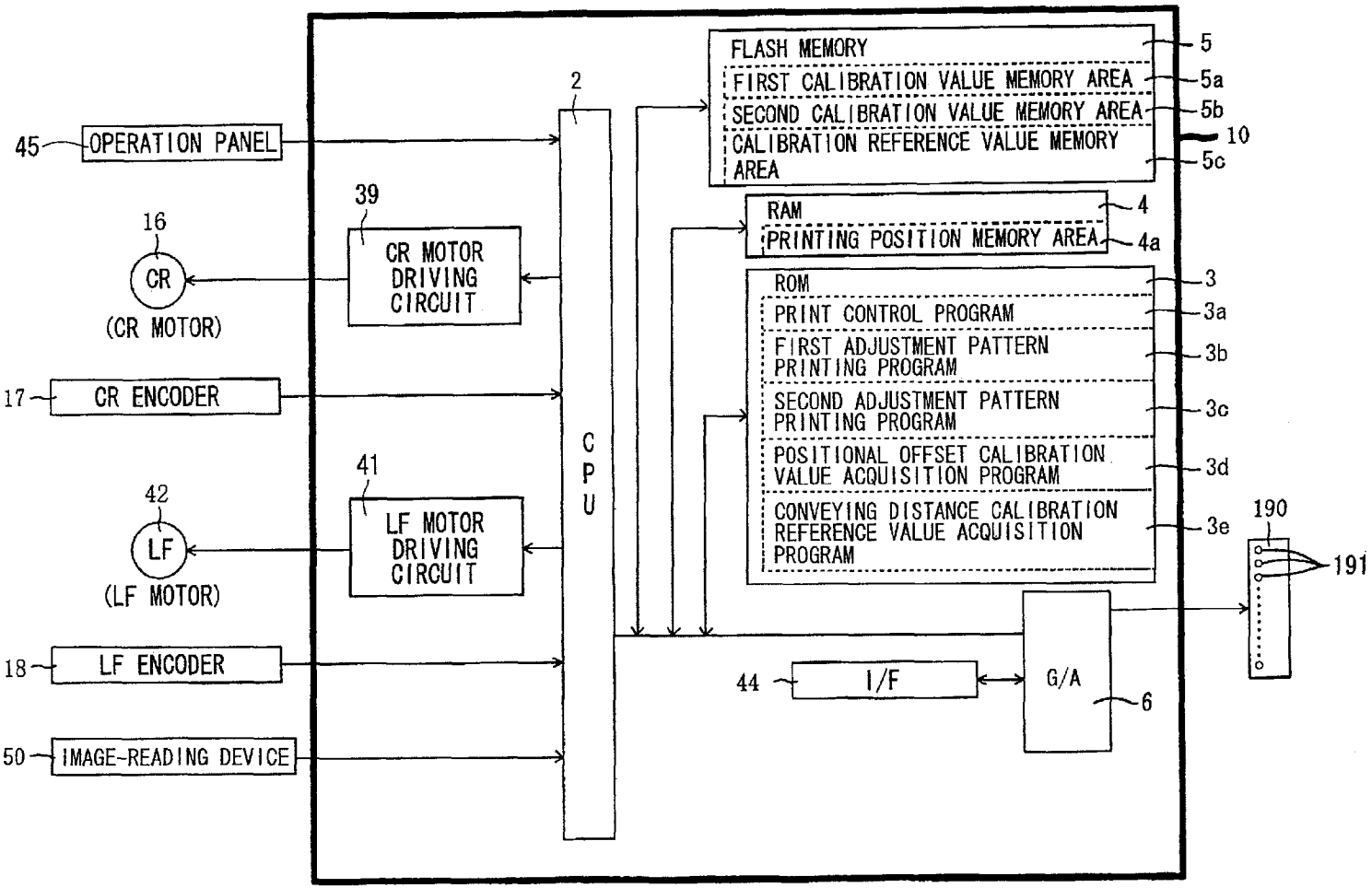
FIG. 1 is a block diagram showing an electrical configuration of a printer according to an embodiment of the present invention.

The printer 1 is an inkjet printer that performs bi-directional printing for forming color images on a recording medium by ejecting ink of different colors from an ink head 190 shown in FIG. 1. That is, the ink head 190 forms images on the recording medium in a forward print and a reverse print while moving in a forward direction and a reverse direction, respectively.

As shown in FIG. 1, the printer 1 includes a control device 10 including a CPU 2, a ROM 3, a RAM 4, a flash memory 5, a gate array (G/A) 6, and an interface (I/F) 44, all connected to one another.

The ROM 3 stores various control programs including a print control program 3*a*, a first adjustment pattern printing program 3*b*, a second adjustment pattern printing program 3*c*, a positional offset calibration value acquisition program 3*d*, and a conveying distance calibration reference value acquisition program 3*e*. The RAM 4 includes a printing position memory area 4*a* for storing a printing position. The flash memory 5 has a first calibration value memory area 5*a* for storing a first positional offset calibration value Af, a second calibration value memory area 5*b* for storing a second positional offset calibration value Ar, and a calibration reference value memory area 5*c* for storing a conveying distance calibration reference value β.

The CPU 2 is connected to and controls an operation panel 45 on which a user inputs various command. The CPU 2 is also connected to and controls a carriage (CR) motor driving circuit 39, a CR encoder 17, a line feed (LF) motor driving circuit 41, and an LF encoder 18. The CPU 2 executes various processes based on the control programs stored in the ROM 3. For example, based on the print control program 3*a*, the CPU 2 processes image data received from a personal computer or a digital camera via a USB or other interface 44 based on user command input on the operation panel 45, and transmits the processed image data to the gate array 6.

The CR motor driving circuit 39 is connected to a CR motor 16 for driving the same. The CR motor 16 is for reciprocatingly moving a carriage 60 (FIG. 2(*a*)) in the main scanning direction (a forward direction F and a reverse direction R (FIG. 10(*a*)). The carriage 60 mounts the ink head 190 thereon. In other wards, the CR motor 16 moves the ink head 190 via the carriage 60 selectively in the forward direction F and the reverse direction R. It should be noted that in the present embodiment, the forward direction F is a direction away from an initial position of the ink head 190, and the reverse direction R is a direction toward the initial position.

Figure 2A:
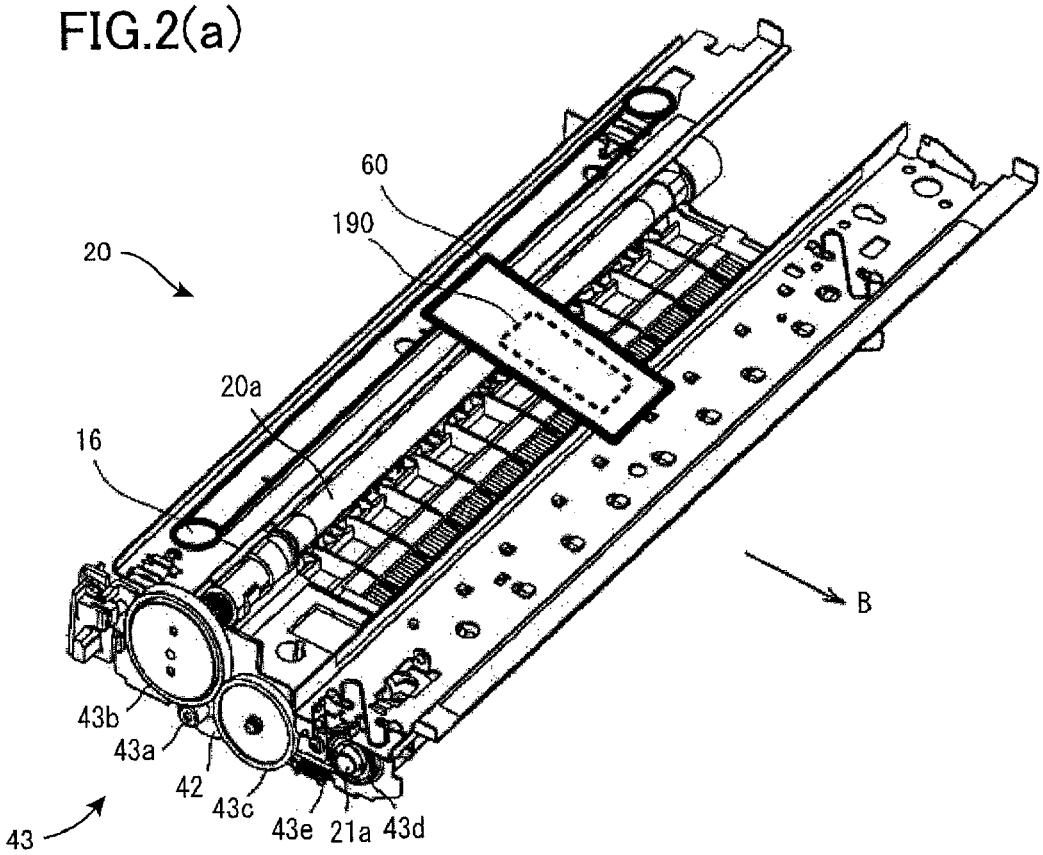
FIG. 2(*a*) is a perspective view of a convey unit of the printer.
Figure 2B:
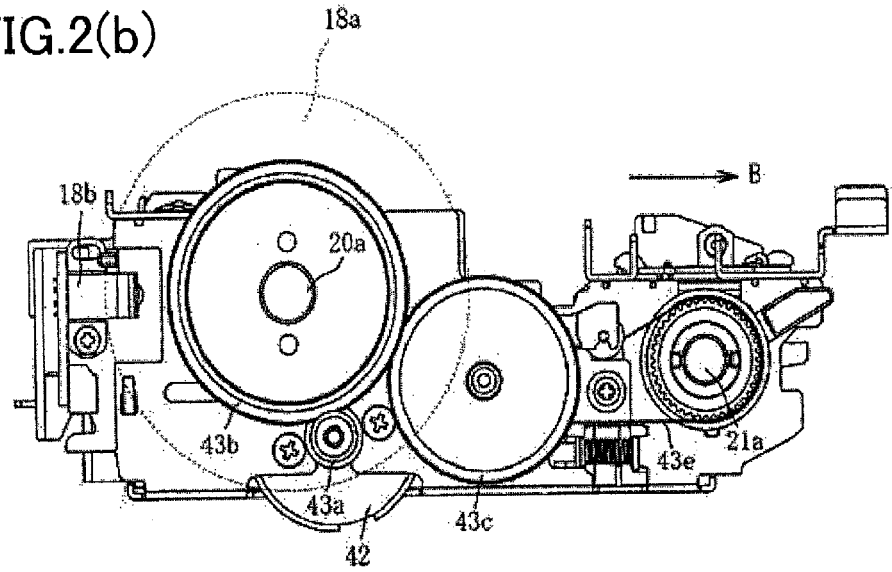

The LF motor driving circuit 41 is connected to and controls an LF motor 42, which in turn drives a convey roller 20*a* (FIG. 2(*a*)) to rotate. The convey roller 20*a* is for conveying a recording medium in a paper-conveying direction B (FIG. 2(*a*)), which is a sub-scanning direction orthogonal to the main scanning direction (the forward direction F and the reverse direction R). That is, the CPU 2 is connected to and drives the LF motor 42 via the LF motor driving circuit 41.

The CR encoder 17 is a linear encoder for detecting a moving amount of the carriage 60. Based on the moving amount detected by the CR encoder 17, the reciprocal movement of the carriage 60 in the main scanning direction is controlled.

The LF encoder 18 is a rotary encoder for detecting a rotating amount of the convey roller 20*a* (FIG. 2(*a*)), and the convey roller 20*a* is controlled based on the rotating amount detected by the LF encoder 18.

The ink head 190 has a row of nozzles 191 formed in a bottom surface thereof (the surface that opposes the recording medium) for each of ink colors, such as cyan, magenta, yellow, blue, and black. The nozzles 191 in each row are aligned in the sub-scanning direction at a prescribed nozzle pitch.

Ink cartridges (not shown) storing ink in each color are connected to each of the nozzles 191 in the ink head 190 via ink channels (not shown) and supply ink thereto.

The gate array 6 is for applying drive voltages, corresponding to the image data processed by the CPU 2, to each piezoelectric actuator for each nozzle 191 of the ink head 190. The drive voltages cause ink of a prescribed amount to be ejected from the ink head 190.

The printer 1 further includes a convey unit 20 shown in FIG. 2(*a*) for conveying a recording medium. The convey unit 20 includes the convey roller 20*a*, a discharge droller 21*a*, the LF motor 42, and a transmitting mechanism 43. The LF motor 42 is rotatable both in a forward direction and a reverse direction.

The transmitting mechanism 43 is for transmitting driving force from the LF motor 42 to the convey roller 20*a* and the discharge droller 21*a*. The transmitting mechanism 43 includes a pinion 43*a* attached to a drive shaft (not shown) of the LF motor 42, a transmission gear 43*b* engaged with the pinion 43*a*, an intermediate gear 43*c* engaged with the transmission gear 43*b*, a discharge gear 43*d*, and a transmission belt 43*e* wound around and extending between the intermediate gear 43*c* and the discharge gear 43*d*. The transmission gear 43*b* is mounted on the left end of the convey roller 20*a*, and the discharge gear 43*d* is mounted on the left end of the discharge roller 21*a*.

Although not shown in the drawings, the convey roller 20*a* opposes a pinch roller and pinches a recording medium therebetween, and the discharge roller 21*a* opposes another pinch roller and pinches the recording medium therebetween. When driven in the forward rotation, the LF motor 42 drives the convey roller 20*a* and the discharge roller 21*a* to rotate, and the convey roller 20*a* and the discharge roller 21*a* convey the recording medium downstream in the paper-conveying direction B.

The LF encoder 18 has a slitted rotating plate 18*a* that is mounted in a position indicated by a dotted line in FIG. 2(*b*). The slitted rotating plate 18*a* has slits formed at prescribed intervals along its circumference. The LF encoder 18 detects the number of slits in the slitted rotating plate 18*a* that pass a photosensor 18*b* (equivalent to the rotational distance of the convey roller 20*a*) and outputs a pulse signal corresponding to the rotational distance of the convey roller 20*a*. As shown in FIG. 2(*b*), the slitted rotating plate 18*a* rotates coaxially with the convey roller 20*a* in the present embodiment.

The CPU 2 generates a control signal based on a bias between the rotational distance of the convey roller 20*a* detected by the LF encoder 18 and a target rotational distance and controls the LF motor 42 through feedback based on the control signal in order to rotate the convey roller 20*a* a distance to compensate for the bias from the target rotational distance. Consequently, the recording medium can be conveyed the desired conveying distance to a target position.

Figures 10A, 10B, 10C, 10D:
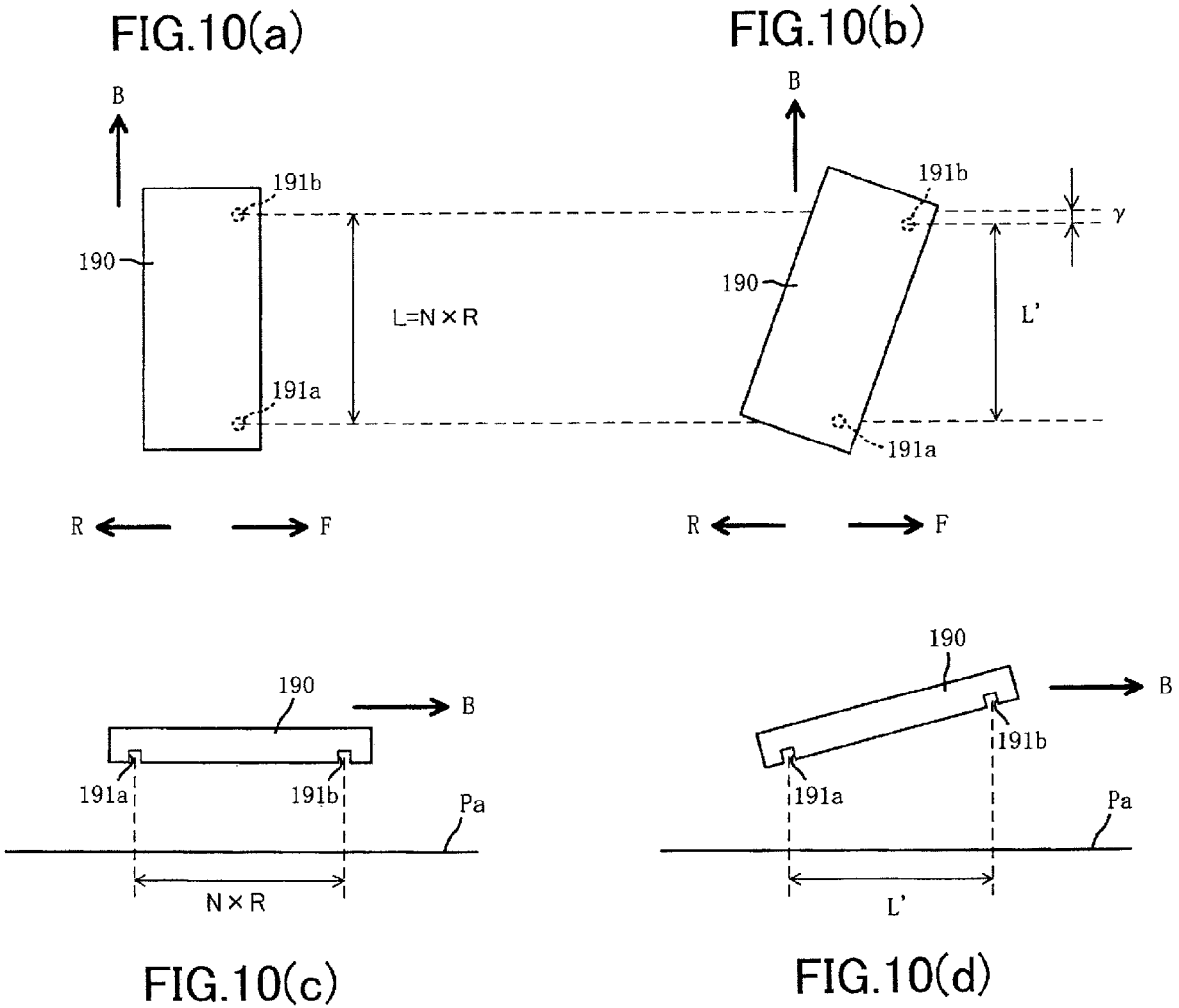
FIG. 10(*a*) is an explanatory plan view of the ink head not tilted with respect to a paper-conveying direction.

In a normal state, the ink head 190 is not tilted with respect to the paper-conveying direction B as shown in FIGS. 10(*a*) and 10(*c*). In this state, a length L in the paper-conveying direction B for a printing region covered during one pass of the ink head 190 is equivalent to the product of the number of nozzles N aligned in the paper-conveying direction B and the nozzle pitch of the ink head 190. However, when the ink head 190 is tilted from the paper-conveying direction B in the main scanning direction (the forward direction F or the reverse direction R), as illustrated in FIG. 10(*b*), or is tilted from the paper-conveying direction B vertically, as illustrated in FIG. 10(*c*), the printing region formed in a single pass has a length L' in the paper-conveying direction B that is shorter than the length L by a length γ.

Thus, the length of the printing region covered in a single pass of the ink head 190 grows shorter as the ink head 190 is tilted more relative to the paper-conveying direction B. The printing results will be adversely affected if the degree of tilt in the ink head 190 relative to the paper-conveying direction B differs in bi-directional printing between a forward print and a reverse print.

Figure 11A:
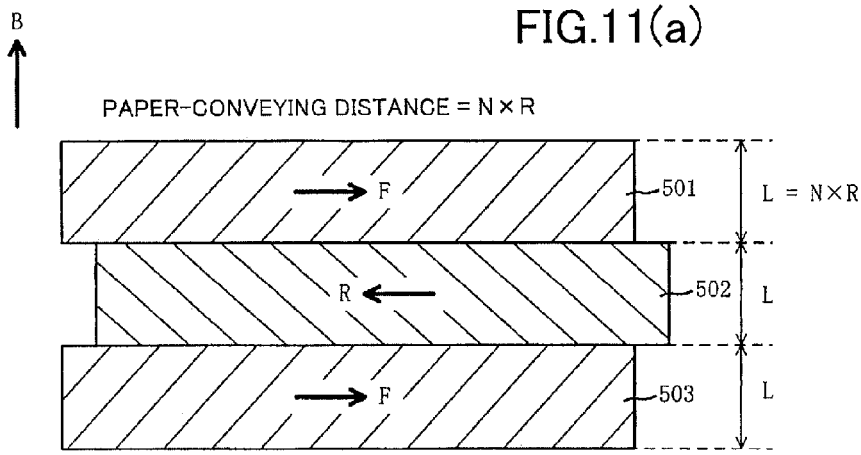
FIG. 11(*a*) is a view conceptually illustrating ideal printing results.
Figure 11B:
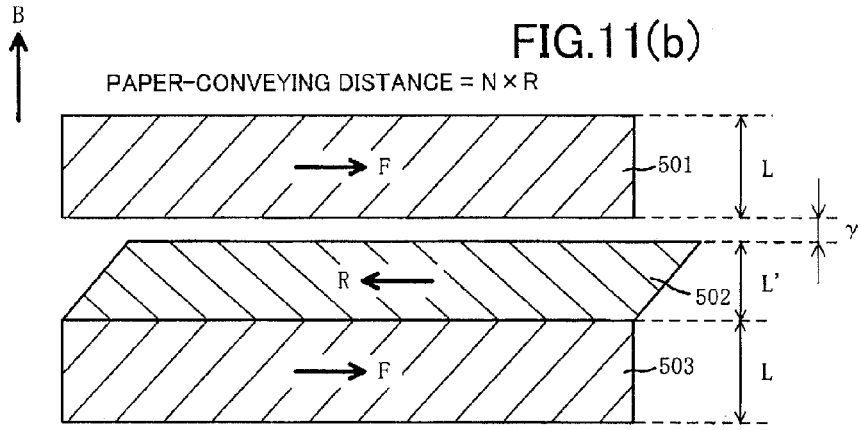

Specifically, printing results such as those shown in FIG. 11(*a*) are obtained when the ink head 190 is not tilted with respect to the paper-conveying direction B in either a forward print or a reverse print. However, if the ink head 190 is tilted relative to the paper-conveying direction B in a reverse print while not tilted in a forward print, the length in the paper-conveying direction B of the printing region covered in the reverse print is shorter than that in the forward print, producing printing results such as those shown in FIG. 11(*b*).

In other words, a gap with the width γ is produced between a printing region 501 covered in the forward print and a printing region 502 covered in the reverse print. This gap produces a white line with a width γ that reduces the quality of the image.

Next, a first adjustment pattern printing process and a positional offset calibration value acquisition process will be described with reference to FIGS. 3(*a*) to 4(*b*). The manufacturer performs these processes through prescribed operations prior to shipping the product. The processes are executed by the CPU 2 based on the first adjustment pattern printing program 3*b* and the positional offset calibration value acquisition program 3*d* stored in the ROM 3.

Figure 4A:
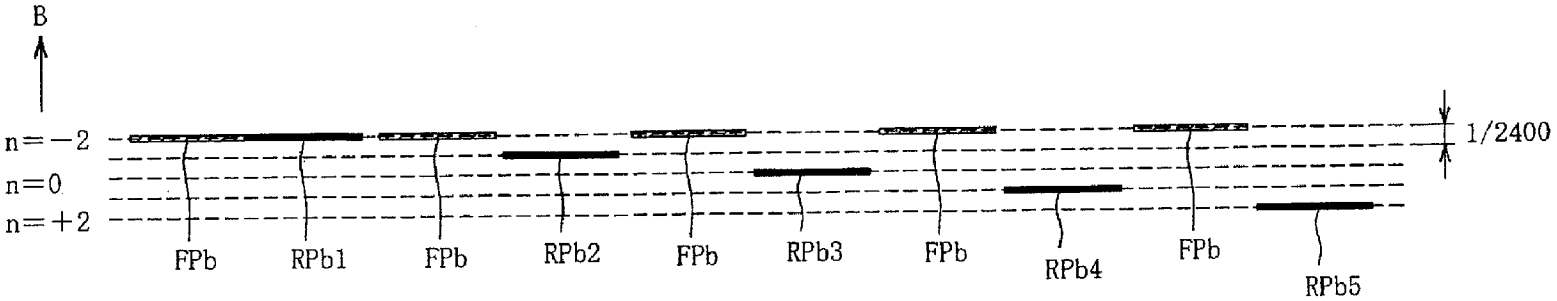
FIG. 4(*a*) is a view conceptually illustrating part of print results of the first adjustment pattern printing process.
Figure 4B:
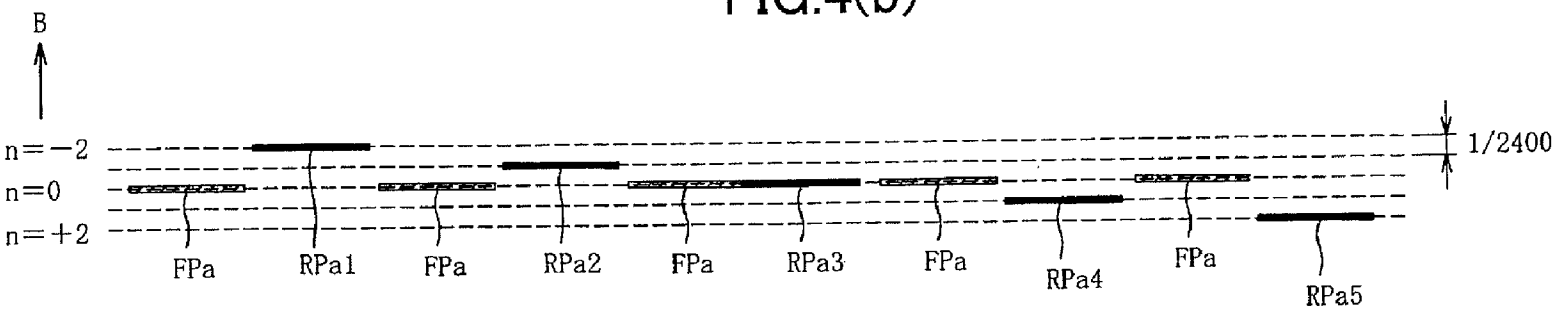

The first adjustment pattern printing process is executed to print an adjustment pattern shown in FIG. 4(*a*) using a most-upstream nozzle 191*a* (FIG. 10(*a*)) that is located most upstream in the paper-conveying direction B and an adjustment pattern shown in FIG. 4(*b*) using a most-downstream nozzle 191*b* (FIG. 10(*a*)) that is located most downstream in the paper-conveying direction B. Based on printed results, the manufacturer can discern whether each ink nozzle 191*a*, 191*b* deviates in the sub-scanning direction when conveyed in the main scanning direction. In the following description, the position of the nozzle 191*a*, 191*b* in the sub-scanning direction when the ink head 190 is conveyed in the forward direction F will be referred to as "forward nozzle position" and the position of the nozzle 191*a*, 191*b* in the sub-scanning direction when conveyed in the reverse direction R will be referred to as "reverse nozzle position." Thus, offset between the forward nozzle position and the reverse nozzle position will appear as offset between printing positions in the forward print and the reverse print.

In the first adjustment pattern printing process, one adjustment pattern RPa is printed by the nozzle 191*a* in a reverse print at each position corresponding to the value of a variable n. Specifically, adjustment patterns RPa1-RPa5 are sequentially formed at each printing position corresponding to n=−2 to n=+2. Further, when the variable n is 0, an adjustment pattern FPa is printed by the nozzle 191*a* in a forward print. Also, one adjustment pattern RPb is printed by the nozzle 191*b* in the reverse print at each position corresponding to the value of the variable n. Specifically, adjustment patterns RPb1-RPb5 are sequentially formed at each printing position corresponding to n=−2 to n=+2. Further, when the variable n is 0, an adjustment pattern FPb is printed by the nozzle 191*b* in the forward print.

Figure 3A:
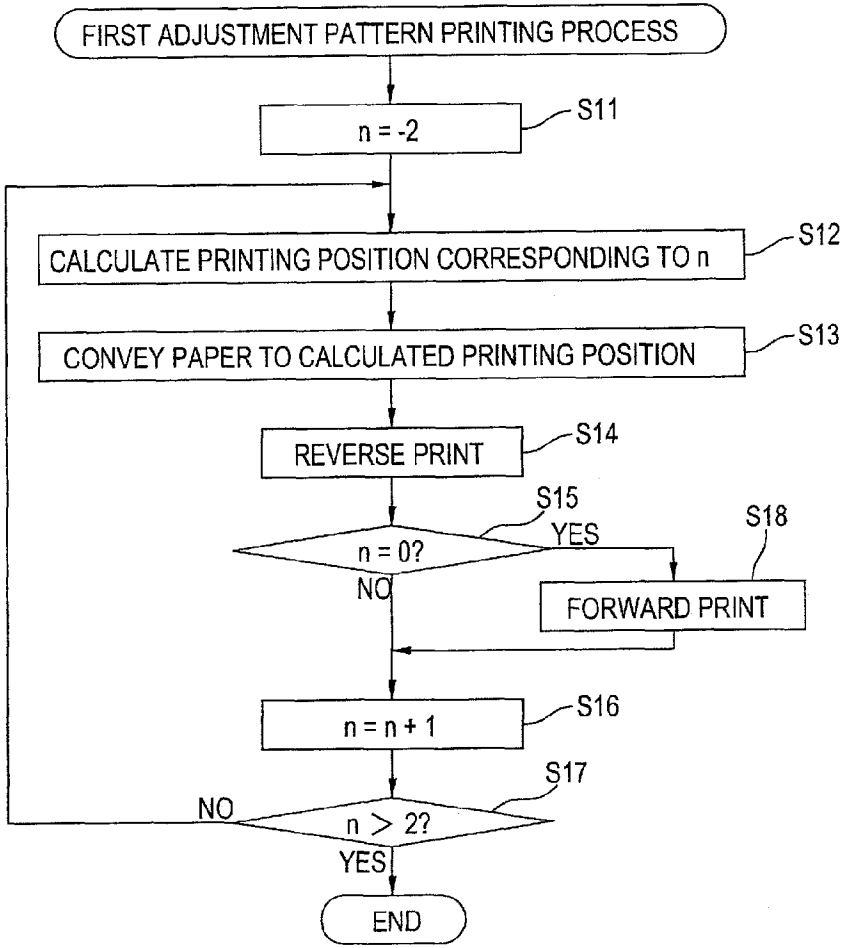
FIG. 3(*a*) is a flowchart representing a first adjustment pattern printing process according to the embodiment.
Figure 3B:
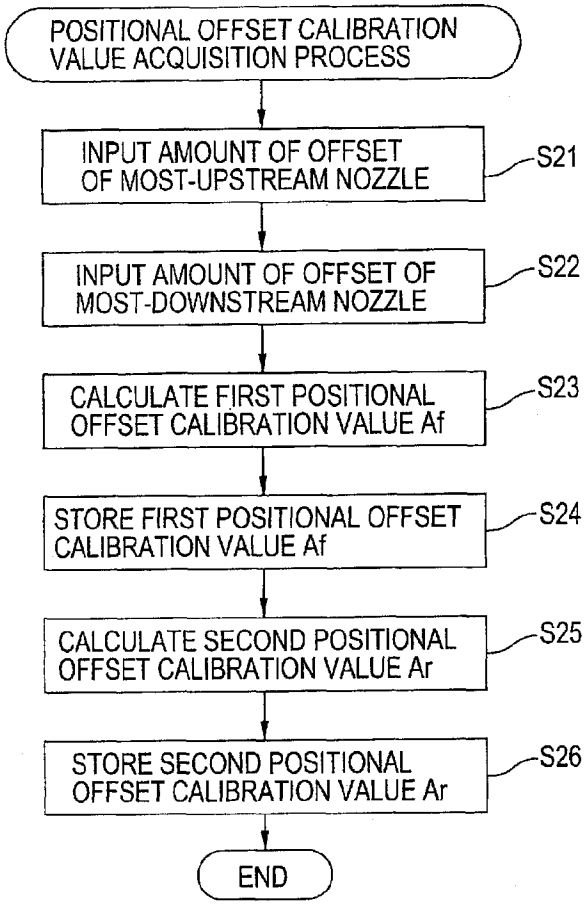

More specifically, in S11 of the first adjustment pattern printing process shown in FIG. 3(*a*), the CPU 2 initializes the variable n to −2. In S12, the CPU 2 calculates a printing position corresponding to the value of the variable n, and in S13, conveys a recording medium to the printing position. The meaning of "conveying a recording medium to a printing position" in this description more precisely means that the recording medium is conveyed to a prescribed position at which printing can be performed at the printing position on the recording medium.

In S14, the CPU 2 conveys the ink head 190 to a reverse print starting position and begins printing the adjustment patterns RPa and RPb (the adjustment patterns RPa1 and RPb1 in this case, see FIGS. 4(*a*) and 4(*b*)) by a reverse print using the nozzles 191*a* and 191*b*, respectively.

Note that the paper-conveying direction B denotes the direction in which a recording medium to be printed is conveyed from a print starting position to a print ending position. The upstream end of the recording medium relative to the paper-conveying direction B is the end on which the last print is performed, while the downstream end of the recording medium is the end on which the first print is performed.

In S15, the CPU 2 determines whether the value of the variable n is 0. If not (S15: NO), the CPU 2 advances to S16. However, if so (S15: YES), then in S18, the CPU 2 prints the adjustment patterns FPa and FPb (FIGS. 4(*a*) and 4(*b*)) by forward printing using the nozzles 191*a* and 191*b*, respectively, and subsequently advances to S16.

In S16, the CPU 2 increments the value of the variable n by 1. Then, in S17, the CPU 2 determines whether or not the value of the variable n is greater than 2. If not (S17:NO), then the CPU 2 returns to S12. On the other hand, if so (S17:YES), then the first adjustment pattern printing process ends.

It should be noted that when n=+1 in S14 (i.e., immediately after performing the forward print for n=0), the ink head 190 is already at the reverse print starting position, so the operation for conveying the ink head 190 to the reverse print starting position is unnecessary.

To facilitate understanding of the drawings in FIGS. 4(*a*) and 4(*b*), the positions of the adjustment patterns RPa and RPb corresponding to each value of the variable n are indicated by dotted lines. Further, in order to help visually distinguish the adjustment patterns RPas and RPbs printed in the reverse prints and the adjustment patterns FPa and FPb printed in the forward print, the fowler is depicted by a solid line and the latter by rectangles with hatching that resemble a solid line.

In the first adjustment pattern printing process described above, a set of the adjustment patterns RPa and RPb (adjustment patterns RPa1-RPa5 and RPb1-RPb5) is printed one at a time in a reverse print each time the variable n is changed sequentially from −2 to +2, i.e., each time the recording medium is conveyed one unit (1/2400 inches in the present embodiment) in the paper-conveying direction B, and the adjustment patterns FPa and FPb are printed in a forward print when the variable n is 0.

In the example shown in FIGS. 4(*a*) and 4(*b*), the adjustment pattern FPa printed in the forward print by the nozzle

191*a* is aligned with the adjustment pattern RPa3 printed in the reverse print by the nozzle 191*a* when the variable n is 0, as shown in FIG. 4(*a*). On the other hand, the adjustment pattern FPb printed in the forward print by the nozzle 191*b* is aligned with the adjustment pattern RPa1 printed in the reverse print by the nozzle 191*b* when the variable n is −2, as shown in FIG. 4(*b*).

If the reverse nozzle position is not offset from the forward nozzle position for both the nozzles 191*a* and 191*b*, the adjustment pattern RPa3 will be aligned with the adjustment pattern FPa, and the adjustment pattern RPb3 will be aligned with the adjustment pattern FPb. In the example shown in FIGS. 4(*a*) and 4(*b*), the reverse nozzle position of the nozzle 191*a* is not offset from the forward nozzle position thereof, but the reverse nozzle position of the nozzle 191*b* is shifted $1/1200$ inches upstream in the paper-conveying direction B from the forward nozzle position thereof.

Here, the amount of offset in the paper-conveying direction B produced with the nozzle 191*a* can be found by subtracting the value of the variable n corresponding to the adjustment pattern FPa (n=0 in the present embodiment) from the value of the variable n corresponding to an adjustment pattern RPa (RPa3 in this example) aligned with the adjustment pattern FPa (n=0 in this example). The amount of offset for the nozzle 191*b*, on the other hand, can be found by subtracting the value of the variable n corresponding to the adjustment pattern FPb (n=0 in the present embodiment) from the value of the variable n corresponding to an adjustment pattern RPb (RPb1 in this example) aligned with the adjustment pattern FPb (n=−2 in this example).

Thus, in the example of FIGS. 4(*a*) and 4(*b*), the amount of offset for the nozzle 191*a* is found to be 0 from the calculation 0−0, and the amount of offset for the nozzle 191*b* is found to be −2 from the calculation (−2)−0.

Be cause the value of the variable n corresponding to the adjustment patterns FPa and FPb is 0 in the present embodiment, the variable n corresponding to the adjustment pattern RPa printed at the same position as the adjustment pattern FPa indicates the amount of offset in the paper-conveying direction B for the nozzle 191*a*, while the variable n corresponding to the adjustment pattern RPb printed at the same position as the adjustment pattern FPb indicates the amount of offset in the paper-conveying direction B for the nozzle 191*b*.

When the printing resolution in the paper-conveying direction B for one pass in either the forward direction F or the reverse direction R is set equivalent to the nozzle resolution of the nozzles 191 formed in the ink head 190 along the sub-scanning direction, if the reverse nozzle position of the nozzle 191*b* is offset upstream of the forward nozzle position (i.e., if n<0), a white line with a width equivalent to the amount of offset between the nozzle positions will be formed between the printing region covered by the forward print and the printing region covered by the subsequent reverse print, as illustrated in FIG. 11(*b*). Under these circumstances, it is necessary to shorten the paper-conveying distance following a forward print by a distance equivalent to the offset between printing positions. In the following description, n denotes the value of the variable n corresponding to either the adjustment pattern RPb or RPa printed at the same position as the corresponding adjustment pattern FPb or FPa.

On the other hand, if the reverse nozzle position of the nozzle 191*b* is offset downstream of the forward nozzle position (i.e., if n>0), an overlap part corresponding to the offset between these nozzle positions will be formed by the printing region covered by the forward print overlapping the printing region covered by the subsequent reverse print. Under these circumstances, it is necessary to lengthen the paper-conveying distance following the forward print by an amount equivalent to the offset between the nozzle positions.

Similarly, if the reverse nozzle position of the nozzle 191*a* is offset upstream of the forward nozzle position (i.e., if n<0), an overlap part corresponding to the offset between these nozzle positions will be formed by the printing region covered by the reverse print overlapping the printing region covered by the subsequent forward print. Under these circumstances, it is necessary to lengthen the paper-conveying distance following the reverse print by an amount equivalent to the offset between the nozzle positions.

However, if the reverse nozzle position of the nozzle 191*a* is offset downstream of the forward nozzle position (i.e., if n>0), a white line with a width equivalent to the amount of the offset between the nozzle positions will be formed by the printing region covered by the reverse print and the printing region covered by the subsequent forward print. Under these circumstances, it is necessary to shorten the paper-conveying distance following the reverse print by an amount equivalent to the offset between the nozzle positions.

The positional offset calibration value acquisition process is executed to find an amount of calibration for calibrating the paper-conveying distance based on the amount of offset found above.

In S21, at the beginning of the positional offset calibration value acquisition process of FIG. 3(*b*), the manufacturer inputs the amount of offset of the nozzle 191*a* obtained from the printing results in the first adjustment pattern printing process described above, and in S22, the manufacturer inputs the amount of offset of the nozzle 191*b* obtained from the printing results in the first adjustment pattern printing process.

In the example of FIGS. 4(*a*) and 4(*b*), the amount of offset is 0 for the nozzle 191*a*, so the manufacturer inputs a "0" in S21. However, the amount of offset is −2 for the nozzle 191*b*, so the manufacturer inputs a "−2" in S22. Note that the manufacturer inputs the amount of offset manually as a numeric value in S21 and S22.

In S23, the CPU 2 calculates a first positional offset calibration value Af based on the amount of offset inputted in S22. The first positional offset calibration value Af is used to calibrate the paper-conveying distance following a forward print and is calculated from the equation Af=(the amount of offset inputted in S22)×(paper-conveying distance for incrementing the variable n by 1 ($1/2400$ inches in the present embodiment)), that is, $n \times 1/2400$. Then, in S24, the CPU 2 stores the first positional offset calibration value Af into the first calibration value memory area 5*a*.

Next in S25, the CPU 2 calculates a second positional offset calibration value Ar based on the amount of offset inputted in S21. The second positional offset calibration value Ar is used to calibrate the paper-conveying distance following a reverse print and is calculated from the equation Ar=−(the amount of offset inputted in S21)×(paper-conveying distance for incrementing the variable n by 1 ($1/2400$ inches in the present embodiment)) that is, $-n \times 1/2400$. Then, in S26, the CPU 2 stores the second positional offset calibration value Ar into the second calibration value memory area 5*b*, and ends the positional offset calibration value acquisition process.

In the example shown in FIGS. 4(*a*) and 4(*b*), the value $-1/1200$ is stored in the first calibration value memory area 5*a* in S24, and the value 0 is stored in the second calibration value memory area 5*b* in S26.

Here, it can be understood that, in the example shown in FIGS. 4(*a*) and 4(*b*), the distance between the nozzles 191*a* and 191*b* is shorter in the reverse direction than in the forward direction, indicating that the ink head 190 tilts during a reverse print greater than in a forward print with respect to the paper-conveying direction B.

Next, a method for finding a conveying distance calibration reference value β will be described with reference to FIGS. 5(*a*) to 6. The conveying distance calibration reference value β is used to calibrate offset between a target conveying distance and an actual conveying distance.

The conveying distance calibration reference value β is obtained in a conveying distance calibration reference value acquisition process shown in FIG. 5(*b*) using a printed result of a second adjustment pattern printing process shown in FIG. 5(*a*). The manufacturer performs these processes through prescribed operations prior to shipping the product. The second adjustment pattern printing process may be performed together with the first adjustment pattern printing process of FIG. 3(*a*) described above.

The second adjustment pattern printing process and the conveying distance calibration reference value acquisition process are executed by the CPU 2 based on the second adjustment pattern printing program 3*c* and the reference conveying distance calibration value acquisition program 3*e*, respectively, stored in the ROM 3.

Figure 6:
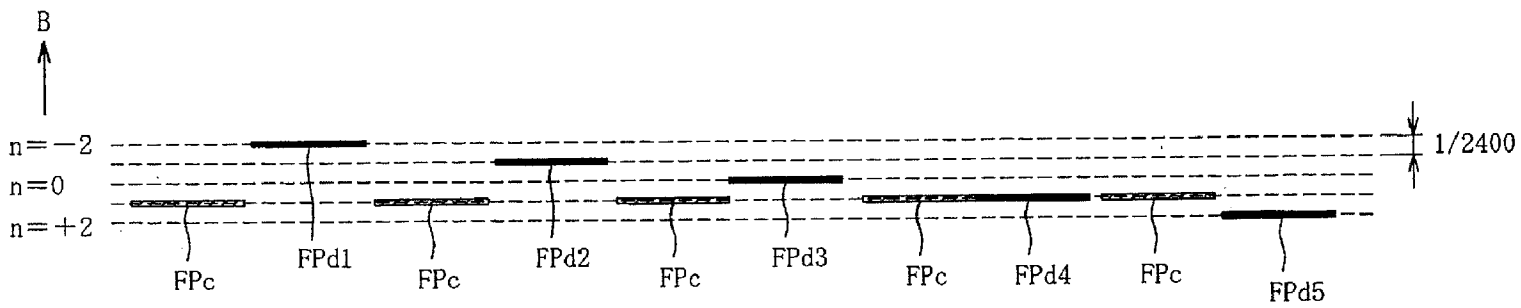
FIG. 6 is a view conceptually illustrating print results of the second adjustment pattern printing process.

In the second adjustment pattern printing process shown in FIG. 5(*a*), first in S31, the CPU 2 conveys a recording medium to a predetermined position, and then in S32, the CPU 2 prints an adjustment pattern FPc shown in FIG. 6 with the most-upstream nozzle 191*a* in a forward print.

In S33, the CPU 2 initializes the variable n to −2. The variable n is a value indicating a printing position and is 0 for the printing position of the adjustment pattern FPc printed by the most-upstream nozzle 191*a* in S32.

In S34, the CPU 2 calculates a printing position for the most-downstream nozzle 191*b* corresponding to the value of the variable n. In S35, the CPU 2 conveys the recording medium to the calculated printing position, and in S36, prints an adjustment pattern FPd (one of adjustment patterns FPd1-FPd5 shown in FIG. 6 corresponding to the value of variable n) with the nozzle 191*b* in a forward print.

In S37, the CPU 2 increments the variable n by 1, and in S38, determines whether the variable n is greater than 2. If not (S38: NO), then the CPU 2 returns to S34 and repeats the process in S34-S38.

On the other hand, if so (S38:YES), then the CPU 2 ends the second adjustment pattern printing process. As a result of the second adjustment pattern printing process, printing results that look something like that shown in FIG. 6 is obtained.

To facilitate understanding of the drawing in FIG. 6, the positions of the adjustment patterns FPd1-FPd5 corresponding to each value of the variable n are indicated by dotted lines. Further, in order to help visually distinguish the adjustment patterns FPds printed with the nozzle 191*b* and the adjustment pattern FPc printed with the nozzle 191*a*, the former is depicted by a solid line and the latter by rectangles with hatching that resemble a solid line.

In the second adjustment pattern printing process described above, the adjustment pattern FPd (adjustment patterns FPd1-RPd5) is printed with the nozzle 191*b* one at a time each time the variable n is changed sequentially from −2 to +2, i.e., each time the recording medium is conveyed one unit (1/2400 inches in the present embodiment) in the paper-conveying direction B. Also, the adjustment pattern FPc is printed with the nozzle 191*a* at what is estimated to be the same printing position as the adjustment pattern FPd3, which is printed at the position corresponding to n=0. In an ideal case in which a predicted conveying distance matches an actual conveying distance, the adjustment pattern FPc is printed at the same position as the adjustment pattern FPd3.

However, when there is a difference (offset) between the predicted conveying distance and the actual conveying distance, the adjustment pattern FPc and the adjustment pattern FPd3 are printed at different positions, as shown in the example of FIG. 6.

FIG. 6 shows a case in which the adjustment pattern FPc is printed at the same position as the adjustment pattern FPd4 corresponding to n=+1. A conveying distance adjustment value is found by subtracting the value of the variable n associated with the position of the adjustment pattern FPc (n=0 in the present embodiment) from the value of the variable n corresponding to the adjustment pattern FPd printed at the same position as the adjustment pattern FPc (n=1 in this example).

Hence, the conveying distance adjustment value is found from the equation [(conveying distance adjustment value)=(value of the variable n corresponding to the adjustment pattern FPd printed at the same position as the adjustment pattern FPc)−(value of the variable n corresponding to the position of the adjustment pattern FPc)].

Hence, the conveying distance adjustment value is a negative value when the actual conveying distance is longer than the predicted conveying distance and a positive value when the actual conveying distance is shorter than the predicted conveying distance.

In the example of FIG. 6, the conveying distance adjustment value is found to be +1 from the calculation (+1)−0. Because the value of the variable n equivalent to the position for the adjustment pattern FPc is 0 in the present embodiment, the conveying distance adjustment value is equal to the value of the variable n corresponding to the adjustment pattern FPd printed at the same position as the adjustment pattern FPc.

In the conveying distance calibration reference value acquisition process shown in FIG. 5(*b*), the conveying distance calibration reference value β is obtained based on the conveying distance adjustment value found above.

In S41 at the beginning of the conveying distance calibration reference value acquisition process shown in FIG. 5(*b*), the manufacturer inputs the conveying distance adjustment value obtained from the printing results in the second adjustment pattern printing process described above. The manufacturer inputs the conveying distance adjustment value manually as a numeric value in S41.

Note that in the present embodiment the manufacturer visually determines the position at which the adjustment pattern FPc matches an adjustment pattern FPd (one of the adjustment patterns FPd1-FPd5) based on the printed results obtained in the second adjustment pattern printing process of FIG. 5(*a*) and sets the conveying distance adjustment value based on this position.

In S42, the CPU 2 calculates a conveying distance calibration reference value β (a value for calibrating the paper-conveying distance) based on the inputted conveying distance adjustment value. Then, in S43, the CPU 2 stores the conveying distance calibration reference value β into the calibration reference value memory area 5*c*, and then ends the conveying distance calibration reference value acquisition process.

Here, the conveying distance calibration reference value β is found by multiplying the paper-conveying distance when incrementing the variable n by 1 (1/2400 inches in the present embodiment) by (the conveying distance adjustment value). Using the example shown in FIG. 6, the conveying distance calibration reference value β obtained in S42 of the process described in FIG. 5(*b*) is (1/2400 inches)×(+1)=+1/2400 inches.

This conveying distance calibration reference value β of +1/2400 is stored in the calibration reference value memory area 5*c*.

Next, a printing process executed by the printer 1 of the present embodiment will be described with reference to FIG. 7. The printing process is executed by the CPU 2 of the printer 1 based on the print control program 3*a* stored in the ROM 3 when the user issues a print command while normal bi-directional printing (printing at different positions in forward prints and reverse prints) is selected.

In the printing process, first in S51, the CPU 2 generates print data from image data to be printed (image data inputted from a PC, for example). Then, in S52, the CPU 2 stores, as a printing position P, an initial value of a printing position (an initial position of a recording medium fed into the printer 1) into the printing position memory area 4*a*.

In S53, the CPU 2 acquires the printing position P from the printing position memory area 4*a*. Then, in S54, the CPU 2 conveys the recording medium to the printing position P. More specifically, in S54, the CPU 2 sets a paper-conveying distance (target rotational amount of the conveying roller 20*a*) to a difference between a current position and the printing position P, and conveys the recording medium to the printing position P by rotating the conveying roller 20*a* the target rotational amount while detecting the rotational amount of the conveying roller 20*a* with the LF encoder 18.

Next, in S55, the CPU 2 determines whether a current print is a reverse print. If not (S55: NO), then in S56, the CPU 2 performs a forward print at the printing position P and advances to S57. On the other hand, if so (S55: YES), then in S59, the CPU 2 performs a reverse print at the printing position P and advances to S57.

In S57, the CPU 2 executes a next printing position setting process to be described later, and then advances to S58. In S58, the CPU 2 determines whether the print data just printed was the last of the print data. If there still remains data to be printed (S58: NO), then the CPU 2 returns to S53 and repeats the above processes on print data that has not been printed. However, if the last of the print data has been printed (S58: YES), the CPU 2 ends the printing process.

Figure 8:
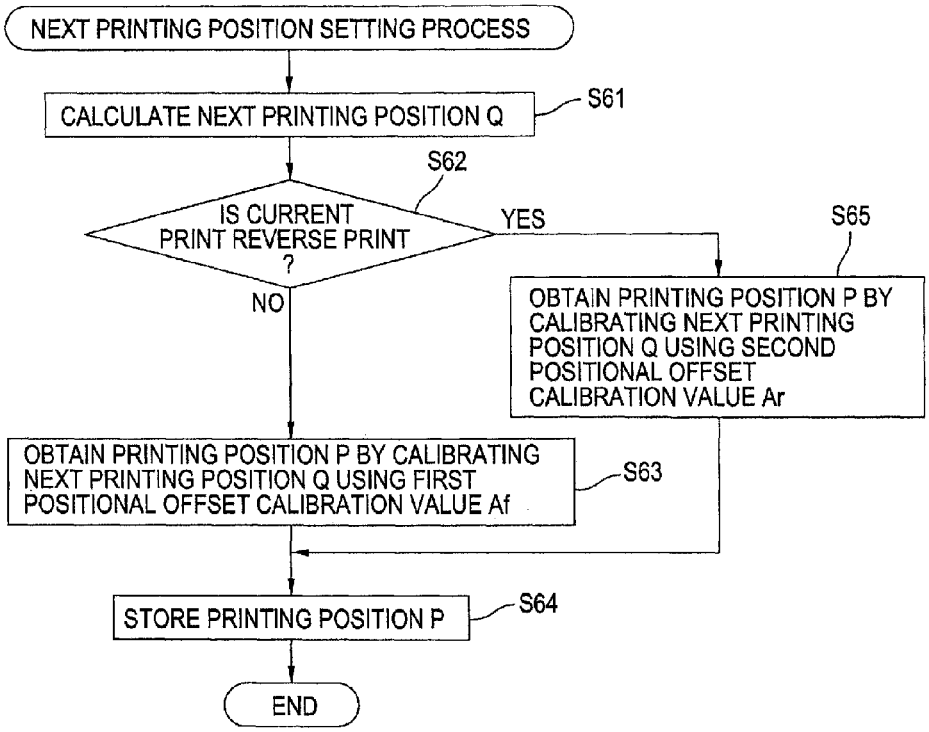
FIG. 8 is a flowchart representing a next printing position setting process according the embodiment.

Next, the next printing position setting process executed in S57 will be described with reference to the flowchart of FIG. 8. The next printing position setting process is for setting a printing position P for a next print.

In the next printing position setting process, first in S61, the CPU 2 calculates a next printing position Q using the conveying distance calibration reference value β stored in the calibration reference value memory area 5*c*.

More specifically, the CPU 2 finds a conveying distance X by adding the conveying distance calibration reference value β stored in the calibration reference value memory area 5*c* to a conveying distance M per pass regulated by a printing mode (conveying distance X=conveying distance M+conveying distance calibration reference value β).

If the printing resolution in the paper-conveying direction B for one pass in either a forward print or a reverse print is set equivalent to the nozzle resolution of the nozzles 191 formed in the ink head 190 along the sub-scanning direction, then (conveying distance M)=(number of nozzles N aligned in the sub-scanning direction)×(nozzle pitch R).

The next printing position Q is subsequently found by adding the conveying distance X to the printing position P stored in the printing position memory area 4*a*. In other words, the next printing position Q is found from the calculation (conveying distance M)+(conveying distance calibration reference value β)+(printing position P).

Next in S62, the CPU 2 determines whether the current print is a reverse print. If not (S62: NO), indicating that the next print is a reverse print, then in S63, the CPU 2 sets the printing position P to a value obtained by calibrating the next printing position Q acquired in S61 using the first positional offset calibration value Af stored in the first calibration value memory area 5*a*. That is, the CPU 2 sets the printing position P to the value found from (next printing position Q)+(first positional offset calibration value Af), and subsequently advances to S64.

On the other hand, if the current print is a reverse print (S62: YES), then in S65, the CPU 2 sets the printing position P to a value obtained by calibrating the next printing position Q acquired in S61 using the second positional offset calibration value Ar stored in the second calibration value memory area 5*b*. That is, the CPU 2 sets the printing position P to the value found from (next printing position Q)+(second positional offset calibration value Ar), and subsequently advances to S64.

In S64, the CPU 2 stores the printing position P found in either S63 or S65 into the printing position memory area 4*a* and subsequently ends the next printing position setting process. Accordingly, when the process in S54 of FIG. 7 is subsequently performed, the recording medium will be conveyed from a current position by a paper-conveying distance calibrated based on a current printing direction (either the forward direction F or the reverse direction R).

Figures 9A, 9B, 9C, 9D, 9E, 9F, 9G, 9H:
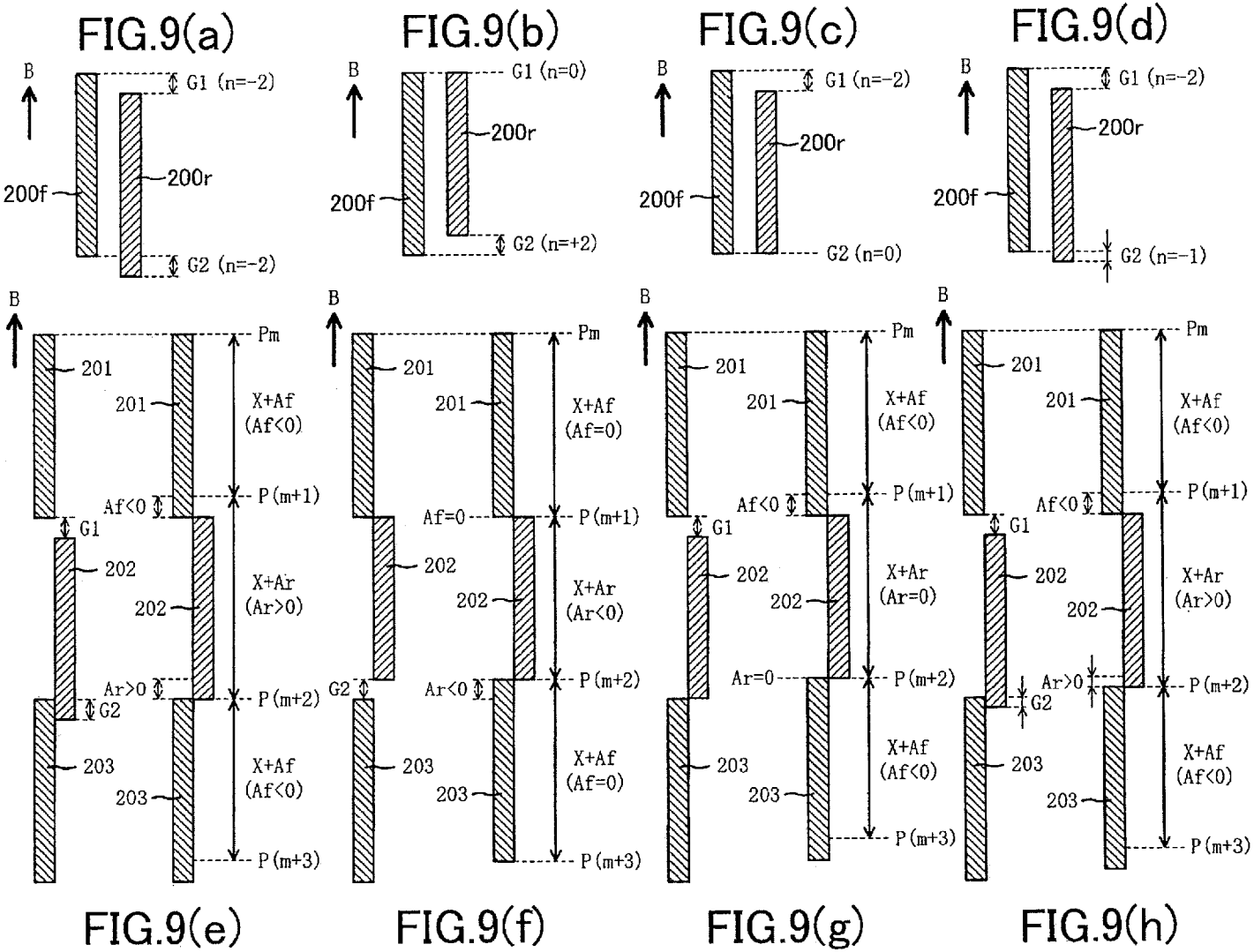
FIG. 9(*a*) is a view conceptually illustrating printing regions covered by a forward print and a reverse print by an ink head of an example.

Next, the effects obtained by executing the printing process in FIG. 7 will be described with reference to FIGS. 9(*a*) to 9(*h*). FIGS. 9(*a*) to 9(*d*) conceptually illustrate a printing region 200*f* covered by a forward print, and a printing region 200*r* covered by a reverse print performed by each ink head 190 without conveying the recording medium after the forward print. To facilitate understanding, the printing regions 200*f* and 200*r* in FIGS. 9(*a*) to 9(*d*) have been separated from each other in the left-to-right direction (main scanning direction).

FIGS. 9(*e*) to 9(*g*) illustrate printing results obtained with the same ink head 190 that produced the printing results shown in FIGS. 9(*a*) to 9(*d*), respectively, when the printing resolution for one pass in either a forward print or a reverse print is set equivalent to the nozzle resolution of the nozzles 191 formed in the ink head 190 along the sub-scanning direction. To facilitate understanding, printing regions 201 and 203 covered by forward prints have been separated from a printing region 202 covered by a reverse print in the left-to-right direction in FIGS. 9(*e*) to 9(*h*).

In the example of FIG. 9(*a*), the length in the paper-conveying direction B (hereinafter simply referred to as "length") of the printing region 200*f* in a forward print is equivalent to the length of the printing region 200*r* covered in a reverse print. This means that the tilt of the ink head 190 during a forward print is equivalent to the tilt of the ink head 190 during a reverse print. However, the reverse nozzle position of the most-downstream nozzle 191*b* is offset upstream of the forward nozzle position in the paper-conveying direction B by an offset amount G1 equivalent to n=−2, and the reverse nozzle position of the most-upstream nozzle 191*a* is offset upstream of the forward nozzle position in the paper-conveying direction B by an offset amount G2 equivalent to n=−2.

If printing is performed without calibrating the paper-conveying distance using the first and second positional offset calibration values Af and Ar, then as illustrated in the left side of FIG. 9(*e*), a white line equivalent to the offset amount G1 will be produced between the printing region 201 covered by a forward print in the $m^{th}$ pass and the printing region 202 covered by a reverse print in the $(m+1)^{th}$ pass, and overlap equivalent to the offset amount G2 will be produced between the printing region 202 covered by a reverse print in the $(m+1)^{th}$ pass and the printing region 203 covered by the subsequent forward print in the $(m+2)^{th}$ pass.

Figure 7:
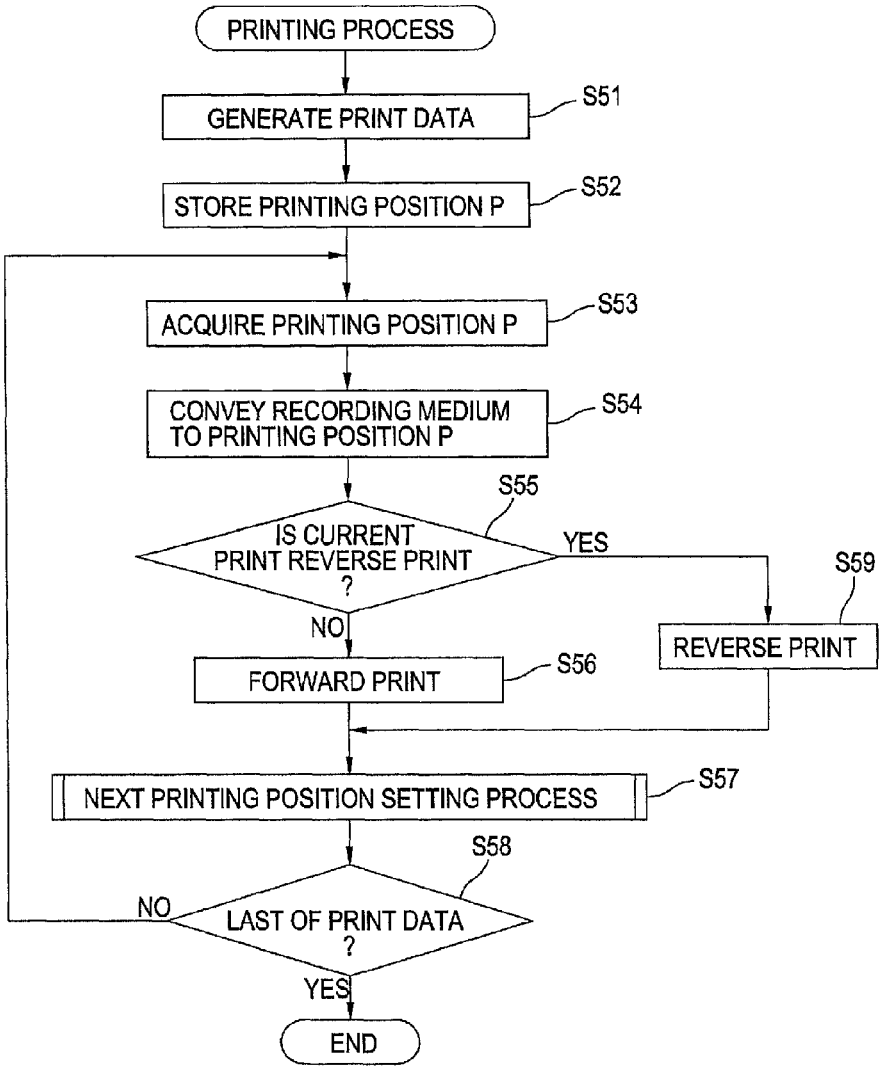
FIG. 7 is a flowchart representing a printing process according to the embodiment.

However, when the printing process in FIG. 7 is executed, the paper-conveying distance after printing in the printing region 201 is calibrated using the first positional offset calibration value Af, which is found from the offset amount G1. Because the offset amount G1 is equivalent to n=−2 in the example shown in FIG. 9(*a*), the first positional offset calibration value Af is set to a negative value (Af<0). Thus, the paper-conveying distance is set shorter than the conveying distance X.

As described above, the "conveying distance X" is a value obtained by adjusting the conveying distance M per pass, which is dependent on the printing mode, by the conveying distance calibration reference value β used to calibrate offset between a predicted conveying distance and an actual conveying distance.

Hence, after printing in the printing region 201, the printer 1 conveys the recording medium from a printing position Pm to a printing position P(m+1) by the conveying distance X+Af (Af<0) and prints in the printing region 202 in a reverse print. This process eliminates the relative positional offset between the forward nozzle position and the reverse nozzle position (hereinafter simply referred to as "positional offset") produced by the nozzle 191*b* so that the upstream edge of the printing region 201 in the paper-conveying direction B is flush with the downstream edge of the printing region 202 as illustrated in the right side of FIG. 9(*e*).

The paper-conveying distance used after printing in the printing region 202 is also calibrated using the second positional offset calibration value Ar, which was found from the offset amount G2. Because the offset amount G2 is equivalent to n=−2 in the example shown in FIG. 9(*a*), the second positional offset calibration value Ar is set to a positive value (Ar>0). Thus, the paper-conveying distance used after printing in the printing region 202 is set greater than the conveying distance X.

Hence, after printing in the printing region 202, the printer 1 conveys the recording medium from the printing position P(m+1) to a printing position P(m+2) by the conveying distance X+Ar (Ar>0) and prints in the printing region 203 in a forward print. This process eliminates the positional offset produced by the most-upstream nozzle 191*a* so that the upstream edge of the printing region 202 in the paper-conveying direction B is flush with the downstream edge of the printing region 203 as illustrated in the right side of FIG. 9(*e*).

Be cause the length of the printing region 200*f* is equivalent to the length of the printing region 200*r*, the total length in the paper-conveying direction B of printing regions covered by a single forward print and a single reverse print is two times the conveying distance X.

There after, the paper-conveying distance after printing in the printing region 203 (the paper-conveying distance from the printing position P(m+2) to the printing position P(m+3)) is identical to the paper-conveying distance (X+Af) from the printing position Pm to the printing position P(m+1), and the paper-conveying distance after printing in a subsequent printing region in a reverse print is identical to the paper-conveying distance (X+Ar) from the printing position P(m+1) to the printing position P(m+2).

In the example shown in FIG. 9(*b*), the length of the printing region 200*f* is greater than the length of the printing region 200*r*. Further, there is no offset between the reverse nozzle position and the forward nozzle position for the most-downstream nozzle 191*b* (i.e., the offset amount G1 is equivalent to n=0). However, the reverse nozzle position of the most-upstream nozzle 191*a* is offset downstream of the forward nozzle position in the paper-conveying direction B by an offset amount G2 equivalent to n=+2.

If printing is performed without calibrating the paper-conveying distance using the first and second positional offset calibration values Af and Ar, then as illustrated in the left side of FIG. 9(*f*), a white line equivalent to the offset amount G2 will be produced between the printing region 202 covered by a reverse print in the $(m+1)^{th}$ pass and the printing region 203 covered by a forward print in the $(m+2)^{th}$ pass.

However, when the printing process in FIG. 7 is executed, as illustrated in the right side of FIG. 9(*f*), the paper-conveying distance after printing in the printing region 201 is calibrated using the first positional offset calibration value Af, which is found from the offset amount G1. However, because the offset amount G1 is equivalent to n=0 in the example of FIG. 9(*b*), the first positional offset calibration value Af is also 0, and the paper-conveying distance remains set to the conveying distance X.

Hence, after printing the printing region 201, the printer 1 conveys the recording paper from the printing position Pm to the printing position P(m+1) by the conveying distance X+Af, or simply X because Af=0, and prints in the printing region 202 in a reverse print. As a result, the upstream edge of the printing region 201 with respect to the paper-conveying direction B is flush with the downstream edge of the printing region 202.

The paper-conveying distance used after printing in the printing region 202 is also calibrated using the second positional offset calibration value Ar, which was found from the offset amount G2. Because the offset amount G2 is equivalent to n=+2 in the example shown in FIG. 9(*b*), the second positional offset calibration value Ar is set to a negative value (Ar<0). Thus, the paper-conveying distance used after printing in the printing region 202 is set shorter than the conveying distance X.

Hence, after printing in the printing region 202, the printer 1 conveys the recording medium from the printing position P(m+1) to a printing position P(m+2) by the conveying distance X+Ar (Ar<0) and prints in the printing region 203 in a forward print. This process eliminates the positional offset produced by the nozzle 191*a* so that the upstream edge of the printing region 202 in the paper-conveying direction B is flush with the downstream edge of the printing region 203 as illustrated in the right side of FIG. 9(*f*).

When the length of the printing region 200*f* differs from the length of the printing region 200*r* as in the example shown in FIG. 9(*b*), the total length of printing regions covered by a single forward print and a single reverse print is equivalent to two times the conveying distance X minus the difference between the length of the printing region 200*f* and the length of the printing region 200*r*.

There after, the paper-conveying distance after printing in the printing region 203 is identical to the paper-conveying distance (X+Af=X) from the printing position Pm to the printing position P(m+1), and the paper-conveying distance after printing in a subsequent printing region in a reverse print is identical to the paper-conveying distance (X+Ar) from the printing position P(m+1) to the printing position P(m+2).

In the example shown in FIG. 9(*c*), the length of the printing region 200*f* is greater than the length of the printing region 200*r*. Further, there is no offset between the reverse nozzle position and the forward nozzle position for the most-upstream nozzle 191*a* (i.e., the offset amount G2 is equivalent to n=0). However, the reverse nozzle position of the most-downstream nozzle 191*b* is offset upstream of the forward nozzle position in the paper-conveying direction B by an offset amount G1 equivalent to n=−2.

If printing is performed without calibrating the paper-conveying distance using the first and second positional offset calibration values Af and Ar, then as illustrated in the left side of FIG. 9(*g*), a white line equivalent to the offset amount G1 will be produced between the printing region 201 covered by a forward print in the $m^{th}$ pass and the printing region 202 covered by a reverse print in the $(m+1)^{th}$ pass.

However, when the printing process in FIG. 7 is executed, as illustrated in the right side of FIG. 9(*g*), the paper-conveying distance after printing in the printing region 201 is calibrated using the first positional offset calibration value Af, which is found from the offset amount G1. Because the offset amount G1 is equivalent to n=−2 in the example shown in FIG. 9(*c*), the first positional offset calibration value Af is set to a negative value (Af<0). Thus, the paper-conveying distance used after printing in the printing region 201 is set shorter than the conveying distance X.

Hence, after printing in the printing region 201, the printer 1 conveys the recording medium from the printing position Pm to a printing position P(m+1) by the conveying distance X+Af(Af<0) and prints in the printing region 202 in a reverse print. This process eliminates the positional offset produced by the nozzle 191*b* so that the upstream edge of the printing region 201 in the paper-conveying direction B is flush with the downstream edge of the printing region 202 as illustrated in the right side of FIG. 9(*g*).

The paper-conveying distance used after printing in the printing region 202 is also calibrated using the second positional offset calibration value Ar, which was found from the offset amount G2. However, because the offset amount G2 is equivalent to n=0 in the example of FIG. 9(*c*), the second positional offset calibration value Af is also 0, and the paper-conveying distance remains set to the conveying distance X.

Hence, after printing in the printing region 202, the printer 1 conveys the recording medium from the printing position P(m+1) to a printing position P(m+2) by the conveying distance X+Ar (Ar=0) or simply X because Ar=0, and prints in the printing region 203 in a forward print. As a result, the upstream edge of the printing region 202 with respect to the paper-conveying direction B is flush with the downstream edge of the printing region 203.

In the example shown in FIG. 9(*c*), the total length of printing regions covered by a single forward print and a single reverse print is equivalent to two times the conveying distance X minus the difference between the length of the printing region 200*f* and the length of the printing region 200*r*.

There after, the paper-conveying distance after printing in the printing region 203 is identical to the paper-conveying distance (X+Af) from the printing position Pm to the printing position P(m+1), and the paper-conveying distance after printing in a subsequent printing region in a reverse print is identical to the paper-conveying distance (X+Ar=X) from the printing position P(m+1) to the printing position P(m+2).

In the example shown in FIG. 9(*d*), the length of the printing region 200*f* is greater than the length of the printing region 200*r*. Also, the reverse nozzle position of the most-downstream nozzle 191*b* is offset upstream of the forward nozzle position in the paper-conveying direction B by an offset amount G1 equivalent to n=−2, and the reverse nozzle position of the most-upstream nozzle 191*a* is offset upstream of the forward nozzle position in the paper-conveying direction B by an offset amount G2 equivalent to n=−1.

If printing is performed without calibrating the paper-conveying distance using the first and second positional offset calibration values Af and Ar, then as illustrated in the left side of FIG. 9(*h*), a white line equivalent to the offset amount G1 will be produced between the printing region 201 covered by a forward print in the $m^{th}$ pass and the printing region 202 covered by a reverse print in the $(m+1)^{th}$ pass, and overlap equivalent to the offset amount G2 will be produced between the printing region 202 covered by the reverse print in the $(m+1)^{th}$ pass and the printing region 203 covered by the subsequent forward print in the $(m+2)^{th}$ pass.

However, when the printing process in FIG. 7 is executed, the paper-conveying distance after printing in the printing region 201 is calibrated using the first positional offset calibration value Af, which is found from the offset amount G1. Because the offset amount G1 is equivalent to n=−2 in the example shown in FIG. 9(*d*), the first positional offset calibration value Af is set to a negative value (Af<0). Thus, the paper-conveying distance is set shorter than the conveying distance X.

Hence, after printing in the printing region 201, the printer 1 conveys the recording medium from a printing position Pm to a printing position P(m+1) by the conveying distance X+Af (Af<0) and prints in the printing region 202 in a reverse print. This process eliminates the positional offset produced by the nozzle 191*b* so that the upstream edge of the printing region 201 in the paper-conveying direction B is flush with the downstream edge of the printing region 202 as illustrated in the right side of FIG. 9(*h*).

The paper-conveying distance used after printing in the printing region 202 is also calibrated using the second positional offset calibration value Ar, which was found from the offset amount G2. Because the offset amount G2 is equivalent to n=−1 in the example shown in FIG. 9(*d*), the second positional offset calibration value Ar is set to a positive value (Ar>0). Thus, the paper-conveying distance used after printing in the printing region 202 is set greater than the conveying distance X.

Hence, after printing in the printing region 202, the printer 1 conveys the recording medium from the printing position P(m+1) to a printing position P(m+2) by the conveying distance X+Ar (Ar>0) and prints in the printing region 203 in a forward print. This process eliminates the positional offset produced by the nozzle 191*a* so that the upstream edge of the printing region 202 in the paper-conveying direction B is flush with the downstream edge of the printing region 203 as illustrated in the right side of FIG. 9(*h*).

In the example shown in FIG. 9(*d*), the total length of printing regions covered by a single forward print and a single reverse print is equivalent to two times the conveying distance X minus the difference between the length of the printing region 200*f* and the length of the printing region 200*r*.

There after, the paper-conveying distance after printing in the printing region 203 is identical to the paper-conveying distance (X+Af) from the printing position Pm to the printing position P(m+1), and the paper-conveying distance after printing in a subsequent printing region in a reverse print is identical to the paper-conveying distance (X+Ar) from the printing position P(m+1) to the printing position P(m+2).

As described above, during bi-directional printing, the printer 1 according to the present embodiment controls the paper-conveying distance following a forward print based on the first positional offset calibration value Af and controls the paper-conveying distance following a reverse print based on the second positional offset calibration value Ar.

Consequently, the printer 1 eliminates positional offset between the forward nozzle position and the reverse nozzle position, even when the printing resolution for one pass in either a forward print or a reverse print is set equivalent to the nozzle resolution. Therefore, the printer 1 can prevent the formation of white lines or overlap between printing regions by aligning the upstream edge of the printing region covered by a forward print with the downstream edge of the printing region in the subsequent reverse print with respect to the paper-conveying direction B, and by aligning the upstream edge of the printing region in the reverse print with the downstream edge of the printing region in the subsequent forward print.

As a result of the control described above, the total length of printing regions covered in a single forward print and a single reverse print is shortened by the difference between the length of the printing region covered in the forward print (i.e., the distance between the nozzles 191*a* and 191*b* during a forward print) and the length of the printing region covered in the reverse print (i.e., the distance between the nozzles 191*a* and 191*b* during a reverse print).

Thus, the printer 1 according to the present embodiment can eliminate offset between printing positions resulting from the relative offset between tilt of the ink head 190 in a forward print and tilt of the ink head 190 in a reverse print. Hence, the printer 1 can prevent the formation of white lines or overlap between printing regions when the printing resolution for one pass in a forward print or reverse print is equivalent to the nozzle resolution.

In other words, the printer 1 according to the present embodiment can eliminate offset between printing positions caused by both relative offset between the printing position during a forward print and the printing position during a reverse print and relative offset between tilt in the ink head 190 relative to the paper-conveying direction B during a forward print and tilt in the ink head 190 relative to the paper-conveying direction B during a reverse print. Accordingly, the printer 1 can adjust the printing positions during forward and reverse prints to ideal positions in order to produce high-quality images in bi-directional printing, even when using an inexpensive mechanism for moving the print head 190, which is often a factor of reduced image quality in bi-directional printing.

Further, the positional offset calibration values Af and Ar are easily obtained based on the adjustment patterns FPa and RPa printed using the most-upstream nozzle 191*a* and the adjustment patterns FPb and RPb printed using the most-downstream nozzle 191*b* (see FIGS. 4(*a*) and 4(*b*)).

As described above, according to the present embodiment, the paper-conveying distance is calibrated based on offset between an actual paper-conveying distance and a predicted paper-conveying distance, it is possible to suppress a decline in image quality caused by offset between the actual paper-conveying distance and the predicted paper-conveying distance.

Further, the offset between an actual paper-conveying distance and a predicted paper-conveying distance can easily be obtained based on the adjustment pattern FPc printed with the nozzle 191*a* and the adjustment patterns FPd printed with the nozzle 191*b*.

While the invention has been described in detail with reference to the embodiments thereof, it would be apparent to those skilled in the art that various changes and modifications may be made therein without departing from the spirit of the invention.

For example, the first calibration value memory area 5*a* may store, instead of the first positional offset calibration value Af, a value based on which the first positional offset calibration value Af can be obtained. For example, the first calibration value memory area 5*a* may store the amount of offset of the nozzle 191*b* inputted in S21 of FIG. 3(*b*). In this case, the first positional offset calibration value Af is calculated based on the amount of offset of the nozzle 191*b* in S63 of FIG. 8.

Similarly, the second calibration value memory area 5*b* can store, instead of the second positional offset calibration value Ar, a value based on which the second positional offset calibration value Ar can be obtained. For example, the second calibration value memory area 5*b* may store the amount of offset of the nozzle 191*a* inputted in S21 of FIG. 3(*b*). In this case, the second positional offset calibration value Ar is calculated based on the amount of offset of the nozzle 191*a* in S65 of FIG. 8.

Further, the calibration reference value memory area 5*c* may store, instead of the conveying distance calibration reference value β, a value based on which the conveying distance calibration reference value β can be obtained. For example, the calibration reference value memory area 5*c* may store a value inputted in S41 of FIG. 5(*b*). In this case, the conveying distance calibration reference value β is calculated in S61 of FIG. 8.

In the above-described embodiment, the first positional offset calibration value Af is found based on the amount of offset between the reverse nozzle position and the forward nozzle position of the nozzle 191*b* and is stored in the first calibration value memory area 5*a*. Similarly, the second positional offset calibration value Ar is found based on the amount of offset between the reverse nozzle position and the forward nozzle position of the nozzle 191*a* and is stored in the second calibration value memory area 5*b*. Thereafter, the paper-conveying distance following a forward print is calibrated using the first positional offset calibration value Af, and the paper-conveying distance following a reverse print is calibrated using the second positional offset calibration value Ar.

However, a calibration value similar to the first positional offset calibration value Af may be found based on a value indicating the offset of the forward nozzle position relative to the reverse nozzle position of the nozzle 191*b* and stored in the first calibration value memory area 5*a*, and a calibration value similar to the second positional offset calibration value Ar may be found based on a value indicating the offset of the forward nozzle position relative to the reverse nozzle position of the nozzle 191*a* and stored in the second calibration value memory area 5*b*. Thereafter, the paper-conveying distance following a reverse print may be calibrated according to the value stored in the first calibration value memory area 5*a*, and the paper-conveying distance following a forward print may be calibrated according to the value stored in the second calibration value memory area 5*b*.

In this case, the printer 1 is configured to print an adjustment pattern in a reverse print in one line and to print multiple adjustment patterns in forward prints for sequential lines in the first adjustment pattern printing process of FIG. 3(*a*).

In the second adjustment pattern printing process of FIG. 5(*a*), the printer 1 is configured to print the adjustment pattern FPc with the nozzle 191*a* in one line and to print the adjustment patterns RPd1-RPd5 with the nozzle 191*b* for sequential lines. However, the printer 1 may conversely be configured to print an adjustment pattern with the nozzle 191*b* in one line and to print multiple adjustment patterns with the nozzle 191*a* for sequential lines.

In the second adjustment pattern printing process according to the above-described embodiment, the printer 1 prints adjustment patterns in a forward print using the nozzles 191*a* and 191*b*, and offset between a predicted conveying distance and an actual conveying distance is found based on the printed patterns. However, the printer 1 may print adjustment patterns in a reverse print using the nozzles 191*a* and 191*b* in a process similar to the second adjustment pattern printing process, and the offset between the predicted conveying distance and the actual conveying distance may be found based on the printed patterns.

Further, although the nozzles 191*a* and 191*b* are used to find the first and second positional offset calibration values Af and Ar in the above-described embodiment, any two nozzles 191 aligned in the paper-conveying direction B may be used to form adjustment patterns in a process similar to that described in FIG. 3(*a*), from which the first and second positional offset calibration values Af and Ar can be obtained.

Similarly, although the nozzles 191*a* and 191*b* are used to find the conveying distance calibration reference value β in the above-described embodiment, any two nozzles 191 aligned in the paper-conveying direction may be used to form adjustment patterns from which the conveying distance calibration reference value β can be obtained through a process similar to that described in FIG. 5(*a*).

In the above-described embodiment, the manufacturer discerns offset between the forward nozzle position and the reverse nozzle position for the nozzles 191*a* and 191*b* visually based on the printed results of the first adjustment pattern printing process. However, the offset amount may be obtained with an image-reading device 50 (FIG. 1) of the printer 1. More specifically, the image-reading device 50 is a scanner or CCD camera including an image sensor (not shown). The CPU 2 controls the image-reading device 50 to read printing results of the adjustment patterns as image data, and determines the position at which the adjustment pattern FPa is aligned with an adjustment pattern RPa and the position at which the adjustment pattern FPb is aligned with an adjustment pattern RPb, and obtains each amount of offset for the nozzle 191*a*, 191*b* based on the determined positions. In this case, the printer 1 may be configured to execute the positional offset calibration value acquisition process of FIG. 3(*b*) upon the CPU 2 obtaining the each amount of offset. Alternatively, a device for obtaining the amount of offset may be an external device. In this case, the amount of offset may be output to an external monitor or the printer 1 via a cable, and in the latter case, the printer 1 may be configured to execute the positional offset calibration value acquisition process of FIG. 3(*b*) upon receiving the inputted amount.

Moreover, in the above-described embodiment, the manufacturer obtains the conveying distance adjustment value visually based on the printed results of the second adjustment pattern printing process. However, the conveying distance adjustment value may be obtained with the image-reading device 50. More specifically, the CPU 2 controls the image-reading device 50 to read printing results of the adjustment patterns as image data, and determines the position at which the adjustment pattern FPc is aligned with an adjustment pattern PPd, and determines a conveying distance adjustment value obtained based on the position of alignment. In this case, the printer 1 may be configured to execute the reference conveying distance calibration value acquisition process of FIG. 5(*b*) upon the CPU 2 obtaining the conveying distance adjustment value. Alternatively, a device for obtaining the conveying distance adjustment value may be an external device. In this case, the conveying distance adjustment value may be output to an external monitor or the printer 1 via a cable, and in the latter case, the printer 1 may be configured to execute the reference conveying distance calibration value acquisition process of FIG. 5(*b*) upon receiving the inputted value.

What is claimed is:

1. An image forming device comprising a print head formed with a plurality of print elements for forming an image on a recording medium, the print elements including a downstream element and an upstream element positioned upstream of the downstream element in a conveying direction;

a head moving mechanism for reciprocatingly moving the print head in a forward direction and a reverse direction opposite from the forward direction, wherein the print head performs a bi-directional printing including a first print for forming a first image while being moved in the forward direction and a second print for forming a second image while being moved in the reverse direction, both the forward direction and the reverse direction being orthogonal to the conveying direction;

a first memory that stores a first value relating to an amount of offset in the conveying direction between a first position on the recording medium at which a first test image is formed with the downstream element in the first print when the recording medium is at a first predetermined position and a second position on the recording medium at which a second test image is formed with the downstream element in the second print when the recording medium is at the first predetermined position;

a second memory that stores a second value relating to an amount of offset in the conveying direction between a third position on the recording medium at which a third test image is formed with the upstream element in the first print when the recording medium is at a second predetermined position and a fourth position on the recording medium at which a fourth test image is formed with the upstream element in the second print when the recording medium is at the second predetermined position;

a first amount determining unit that determines a first amount by correcting a predetermined amount based on the first value stored in the first memory;

a second amount determining unit that determines a second amount by correcting the predetermined amount based on the second value stored in the second memory; and a conveying mechanism that conveys the recording medium toward a downstream side in the conveying direction relative to the print head the first amount after one of the first print and the second print is performed and the second amount after the other of the first print and the second print is performed.

2. The image forming device according to claim 1, further comprising:

a third memory that stores a third value relating to a difference between a target conveying amount of the recording medium and an actual conveying amount of the recording medium; and a third amount determining unit that determines the predetermined amount by correcting the target conveying amount based on the third value stored in the third memory.

3. The image forming device according to claim 1, further comprising:

a first control unit that controls the print head, the head moving mechanism, and the conveying mechanism to perform a first pattern printing to print plurality of pairs of a first pattern and a second pattern one at a time in one of the first print and the second print each time the recording medium is conveyed one unit, the first pattern being printed with the downstream element, the second pattern being printed with the upstream element, one of the pairs of the first pattern and the second pattern being printed when the recording medium is at a reference position;

a second control unit that controls the print head, the head moving mechanism, and the conveying mechanism to perform a second pattern printing to print a pair of a third pattern and a fourth pattern in the other of the first print and the second print on the recording medium at the reference position, the third pattern being printed with the downstream element, the fourth pattern being printed with the upstream element;

a first value acquisition unit that acquires the first value based on printed positions of the first patterns and the third pattern; and a second value acquisition unit that acquires the second value based on printed positions of the second patterns and the fourth pattern.

4. A control method for controlling an image forming device including: a print head formed with a plurality of print elements for forming an image on a recording medium, the print elements including a downstream element and an upstream element positioned upstream of the downstream element in a conveying direction; a head moving mechanism for reciprocatingly moving the print head in a forward direction and a reverse direction opposite from the forward direction, wherein the print head performs a bi-directional printing including a first print for forming a first image while being moved in the forward direction and a second print for forming a second image while being moved in the reverse direction, and both the forward direction and the reverse direction are orthogonal to the conveying direction; a first memory that stores a first value relating to an amount of offset in the conveying direction between a first position on the recording medium at which a first test image is formed with the downstream element in the first print when the recording medium is at a first predetermined position and a second position on the recording medium at which a second test image is formed with the downstream element in the second print when the recording medium is at the first predetermined position; a second memory that stores a second value relating to an amount of offset in the conveying direction between a third position on the recording medium at which a third test image is formed with the upstream element in the first print when the recording medium is at a second predetermined position and a fourth position on the recording medium at which a fourth test image is formed with the upstream element in the second print when the recording medium is at the second predetermined position, wherein the control method comprising:

determining a first amount by correcting a predetermined amount based on the first value stored in the first memory;

determining a second amount by correcting the predetermined amount based on the second value stored in the second memory;

conveying the recording medium toward a downstream side in the conveying direction relative to the print head the first amount after one of the first print and the second print is performed; and conveying the recording medium toward the downstream side in the conveying direction relative to the print head the second amount after the other of the first print and the second print is performed.

5. A storage medium storing a set of program instructions executable on a data processing device and usable for controlling an image forming device including: a print head formed with a plurality of print elements for forming an image on a recording medium, the print elements including a downstream element and an upstream element positioned upstream of the downstream element in a conveying direction; a head moving mechanism for reciprocatingly moving the print head in a forward direction and a reverse direction opposite from the forward direction, wherein the print head performs a bi-directional printing including a first print for forming a first image while being moved in the forward direction and a second print for forming a second image while being moved in the reverse direction, and both the forward direction and the reverse direction are orthogonal to the conveying direction; a first memory that stores a first value relating to an amount of offset in the conveying direction between a first position on the recording medium at which a first test image is formed with the downstream element in the first print when the recording medium is at a first predetermined position and a second position on the recording medium at which a second test image is formed with the downstream element in the second print when the recording medium is at the first predetermined position; a second memory that stores a second value relating to an amount of offset in the conveying direction between a third position on the recording medium at which a third test image is formed with the upstream element in the first print when the recording medium is at a second predetermined position and a fourth position on the recording medium at which a fourth test image is formed with the upstream element in the second print when the recording medium is at the second predetermined position, instructions comprising:

determining a first amount by correcting a predetermined amount based on the first value stored in the first memory;

determining a second amount by correcting the predetermined amount based on the second value stored in the second memory;

conveying the recording medium toward a downstream side in the conveying direction relative to the print head the first amount after one of the first print and the second print is performed; and conveying the recording medium toward the downstream side in the conveying direction relative to the print head the second amount after the other of the first print and the second print is performed.

* * * * *